US007984620B2

(12) United States Patent
Shimamoto et al.

(10) Patent No.: US 7,984,620 B2
(45) Date of Patent: Jul. 26, 2011

(54) AIR CONDITIONING APPARATUS

(75) Inventors: Daisuke Shimamoto, Tokyo (JP); Munehiro Yamanaka, Tokyo (JP); Hidekazu Tani, Tokyo (JP); Tomohiko Kasai, Tokyo (JP); Masahiro Tsuda, Tokyo (JP); Shuji Oura, Tokyo (JP); Makoto Saitou, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/108,346

(22) Filed: Apr. 23, 2008

(65) Prior Publication Data

US 2008/0196432 A1 Aug. 21, 2008

Related U.S. Application Data

(62) Division of application No. 10/533,535, filed as application No. PCT/JP02/11296 on Oct. 30, 2002, now Pat. No. 7,493,775.

(51) Int. Cl.
*F25B 13/00* (2006.01)

(52) U.S. Cl. ..... 62/324.1; 62/324.6

(58) Field of Classification Search ..... 62/324.1, 62/324.6, 238.7, 200, 199, 160
See application file for complete search history.

(56) References Cited

U.S. PATENT DOCUMENTS

| | | | | |
|---|---|---|---|---|
| 3,979,922 | A * | 9/1976 | Shavit | 62/97 |
| 4,987,747 | A * | 1/1991 | Nakamura et al. | 62/160 |
| 5,142,879 | A * | 9/1992 | Nakamura et al. | 62/160 |
| 5,347,826 | A * | 9/1994 | Hayashida et al. | 62/197 |
| 5,369,958 | A * | 12/1994 | Kasai et al. | 62/158 |
| 5,752,389 | A * | 5/1998 | Harper | 62/176.5 |
| 6,321,558 | B1 * | 11/2001 | Pruse | 62/324.6 |
| 6,510,698 | B2 * | 1/2003 | Kasai et al. | 62/77 |
| 2002/0026800 | A1 * | 3/2002 | Kasai et al. | 62/85 |

FOREIGN PATENT DOCUMENTS

| | | |
|---|---|---|
| JP | 50-37161 | 10/1975 |
| JP | 5-99525 | 4/1993 |
| JP | 6-241534 | 8/1994 |
| JP | 7-54218 | 6/1995 |
| JP | 07-151419 | 6/1995 |
| JP | 7-104075 | 11/1995 |
| JP | 8-14438 | 1/1996 |
| JP | 2522430 | 5/1996 |
| JP | 9-119659 | 5/1997 |

(Continued)

OTHER PUBLICATIONS

English abstract to JP 2000-105014 to Shimamoto et al.*

(Continued)

*Primary Examiner* — Mohammad Ali
(74) *Attorney, Agent, or Firm* — Oblon, Spivak, McClelland, Maier & Neustadt, L.L.P.

(57) ABSTRACT

An air conditioning apparatus has plural indoor units having: plural heat exchangers; and flow controllers respectively corresponding to the heat exchangers. In each of the indoor units, one heat exchanger is used as a condenser, and another heat exchanger is used as an evaporator, thereby causing the indoor unit to perform a temperature and humidity controlling operation. An indoor unit(s) which is not set to perform the temperature and humidity controlling operation may be caused to perform a heating operation or a cooling operation. Capacity controls on the condensers and the evaporators are performed by corresponding flow controllers. Gas refrigerants ejected from plural heat exchangers serving as evaporators are joined together, and then distributed to plural heat exchangers serving as condensers.

15 Claims, 30 Drawing Sheets

FOREIGN PATENT DOCUMENTS

| | | |
|---|---|---|
| JP | 2692856 | 9/1997 |
| JP | 10-197028 | 7/1998 |
| JP | 2000-18766 | 1/2000 |
| JP | 2000-105014 | 4/2000 |
| JP | 2001-201207 | 7/2001 |
| JP | 2002-54832 | 2/2002 |
| JP | 2002-89988 | 3/2002 |

OTHER PUBLICATIONS

English translation to JP 2000-105014 A to Shimamoto et al.*

* cited by examiner (FIG. 1 CONTINUED)

A: HEAT SOURCE DEVICE
B, C: STANDARD INDOOR UNIT
D, E: REHEATER
F: RELAY DEVICE
1: COMPRESSOR
2: FOUR-WAY REVERSING VALVE
3: HEAT SOURCE DEVICE HEAT EXCHANGER
4: ACCUMULATOR
5B, 5C: INDOOR HEAT EXCHANGER
5D, 5E: REHEATER HEAT EXCHANGER
6: FIRST CONNECTING PIPE
7: SECOND CONNECTING PIPE
6B-6E: FIRST CONNECTING PIPE ON THE INDOOR UNIT/REHEATER SIDE
7B-7E: SECOND CONNECTIN PIPE ON THE INDOOR UNIT/REHEATER SIDE
8B-8E: THREE-WAY REVERSING VALVE
9B-9E: FIRST FLOW CONTROLLER
10: FIRST BRANCHING PORTION
11: SECOND BRANCHING PORTION
12: GAS-LIQUID SEPARATOR
13: SECOND FLOW CONTROLLER
14: FIRST BYPASS PIPE
15: THIRD FLOW CONTROLLER
16A: SECOND HEAT EXCHANGING PORTION
16B-16E: THIRD HEAT EXCHANGING PORTION
17: FOURTH FLOW CONTROLLER
18: FOURTH PRESSURE DETECTING MEANS
19: FIRST HEAT EXCHANGING PORTION
20: HEAT SOURCE DEVICE BLOWER
25: FIRST PRESSURE DETECTING MEANS
26: SECOND PRESSURE DETECTING MEANS
27B-27E: FOURTH TEMPERATURE DETECTING MEANS
28B-28E: FIFTH TEMPERATURE DETECTING MEANS
32: FIRST CHECK VALVE
33: SECOND CHECK VALVE
34: THIRD CHECK VALVE
35: FOURTH CHECK VALVE
36B, 36C: INDOOR UNIT FAN
40: HEAT SOURCE DEVICE SWITCHING VALVE
41, 42: FIRST, SECOND HEAT SOURCE DEVICE HEAT EXCHANGERS
43: HEAT SOURCE DEVICE HEAT EXCHANGER BYPASS PIPE
44-48: FIRST TO FIFTH ELECTROMAGNETIC CONTROL VALVES
50: FIRST CIRCULATING COMPOSITION DETECTING DEVICE
51: SECOND BYPASS PIPE
G, H: HUMIDIFIER
52: FOURTH HEAT EXCHANGING PORTION
53: FIRST PRESSURE REDUCING DEVICE
54: FIRST TEMPERATURE DETECTING MEANS
55: SECOND TEMPERATURE DETECTING MEANS
56: FIFTH PRESSURE DETECTING MEANS
57: THIRD TEMEPERATURE DETECTING MEANS
58: TEMPERATURE DETECTING MEANS
59: SIXTH TEMPERATURE DETECING MEANS
60: SEVENTH TEMPERATURE DETECTING MEANS

66: WATER TANK
67: WATER SUPPLY ADJUSTING VALVE

CONTROL OF STANDARD INDOOR UNIT

CONTROL OF REHEATER

CONTROL OF HUMIDIFIER

CONTROL OF STANDARD INDOOR UNIT

CONTROL OF REHEATER

CONTROL OF HUMIDIFIER (FIG. 20 CONTINUED)

A: HEAT SOURCE DEVICE
B, C: STANDARD INDOOR UNIT
D, E: REHEATER
F1-F4: RELAY DEVICE
G, H: HUMIDIFIER
1: COMPRESSOR
3: HEAT SOURCE DEVICE HEAT EXCHANGER
5B, 5C: INDOOR HEAT EXCHANGER
5D, 5E: REHEATER HEAT EXCHANGER
6: FIRST CONNECTING PIPE
7: SECOND CONNECTING PIPE
9B-9E: FIRST FLOW CONTROLLER
20: HEAT SOURCE DEVICE BLOWER
27B-27E: FOURTH TEMPERATURE DETECTING MEANS
28B-28E: FIFTH TEMPERATURE DETECTING MEANS
36B, 36C: INDOOR UNIT FAN
58B, 58C: TEMPERATURE DETECTING MEANS
59B, 59C: THIRD DETECTING MEANS
60B, 60C: FOURTH TEMPERATURE DETECTING MEANS
100: FIRST REVERSING VALVE
101: SECOND REVERSING VALVE
102F1-102F4: THIRD REVERSING VALVE
103F1-103F4: FOURTH REVERSING VALVE
104: THIRD PIPE
108: PRESSURE SENSING MEANS

AIR CONDITIONING APPARATUS

CROSS-REFERENCE TO RELATED APPLICATIONS

This application is a Divisional of and claims the benefit of priority under 35 U.S.C. §120 from U.S. Ser. No. 10/533,535, filed Jun. 22, 2006 and claims the benefit of International Application No. PCT/JP02/11296, filed Oct. 30, 2002.

TECHNICAL FIELD

The present invention relates to an air conditioning apparatus which has an outdoor unit and plural indoor units, and which can perform cooling and heating operations.

BACKGROUND ART

JP-A-5-99525 and JP-A-2000-105014 disclose a simultaneous cooling/heating type air conditioning apparatus in which a heat source device is connected to plural indoor units through refrigerant pipes, and each of the indoor units can perform cooling and heating operations.

JP-A-2002-89988 discloses an air conditioning apparatus in which one heat source device is connected to one indoor unit through refrigerant pipes, and two heat exchangers are connected to the indoor unit via a flow control valve, and which can perform a cooling operation, a heating operation, a cooling, reheating, and dehumidifying operation, and a heating, reheating, and dehumidifying operation.

However, the air conditioning apparatuses of JP-A-5-99525 and JP-A-2000-105014 have a problem in that a humidity control other than a temperature control cannot be performed. The air conditioning apparatus disclosed in JP-A-2002-89988 has a problem in that plural indoor units cannot be individually held to an optimum temperature and humidity condition.

DISCLOSURE OF THE INVENTION

The invention has been conducted in order to solve the above-discussed problems. It is an object of the invention to provide an air conditioning apparatus in which an outdoor unit is connected to plural indoor units, and each of the indoor units can perform a temperature control such as a cooling operation or a heating operation, and a humidity control such as a humidifying operation and a dehumidifying operation.

In order to attain the object, according to the invention, a gas refrigerant is flown into at least one indoor unit heat exchanger in at least one indoor unit to cause a heating operation to be performed, a gas refrigerant is flown into at least one indoor unit heat exchanger in at least one other indoor unit, and a liquid refrigerant is flown into at least one of remaining indoor unit heat exchangers to cause a temperature and humidity controlling operation to be performed; and a liquid refrigerant is flown into at least one indoor unit heat exchanger in at least one indoor unit to cause a cooling operation to be performed, a gas refrigerant is flown into at least one indoor unit heat exchanger in at least one other indoor unit, and a liquid refrigerant is flown into at least one of remaining indoor unit heat exchangers to cause a temperature and humidity controlling operation to be performed.

According to the configuration, a cooling operation, a heating operation, or a temperature and humidity controlling operation can be performed in each room, and temperatures and humidities of plural rooms or places can be controlled.

BEST MODE FOR CARRYING OUT THE INVENTION

Hereinafter, the best mode for carrying out the invention will be described with reference to the drawings.

Embodiment 1

Figure 1:
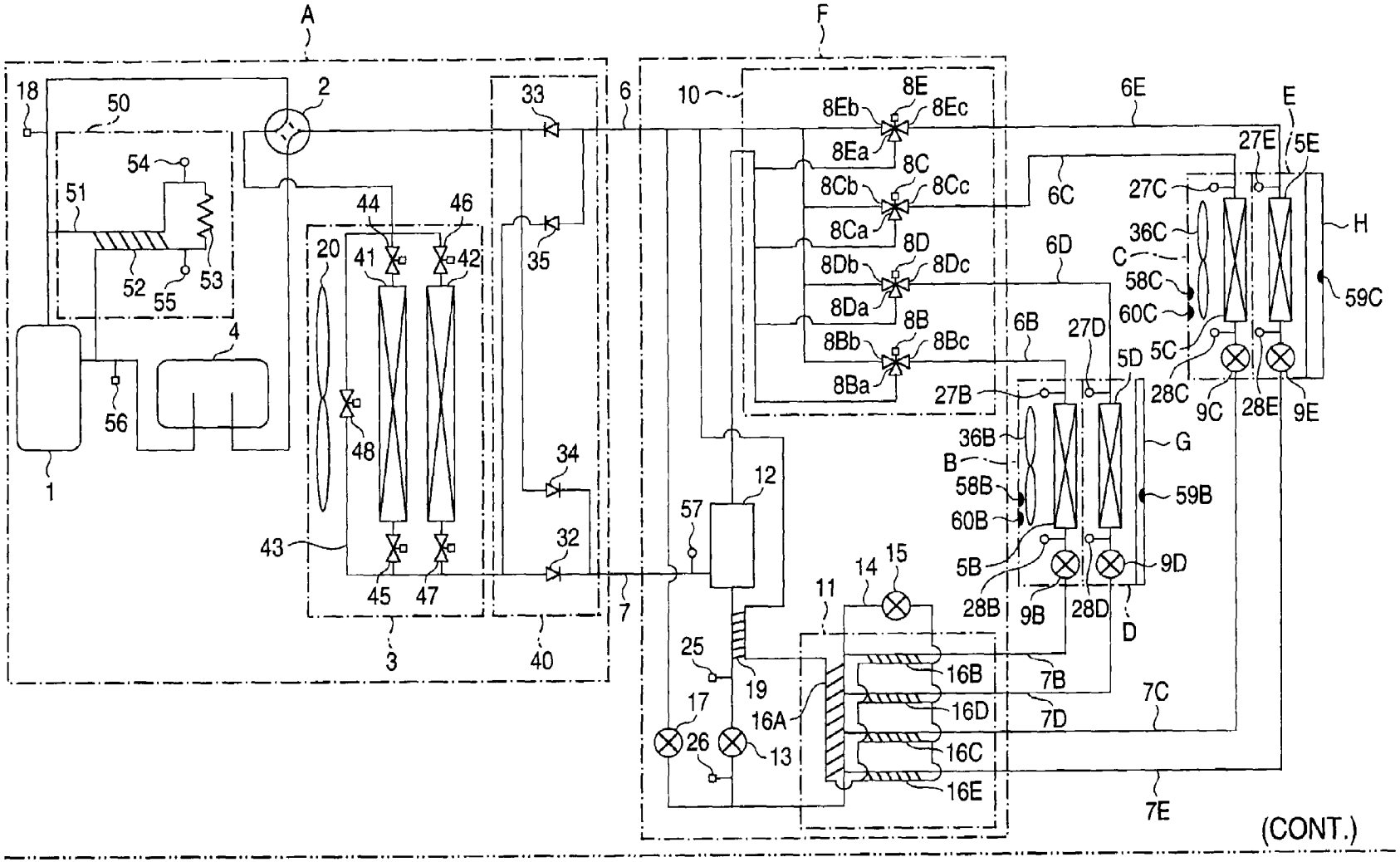
FIG. 1 is a refrigerant circuit diagram of Embodiment 1.

FIG. 1 is a refrigerant circuit diagram of an air conditioning apparatus of Embodiment 1 of the invention.

Referring to FIG. 1, the air conditioning apparatus is mainly configured by connecting a heat source device (A), a first indoor unit comprising: a standard indoor unit (B); a reheater (D); and a humidifier (G), a second indoor unit comprising: a standard indoor unit (C); a reheater (E); and a humidifier (H), and a relay device (F) through refrigerant pipes.

Although the configuration in which two indoor units are used will be described, the number of indoor units is not restricted to two, and any number of indoor units may be used.

The heat source device (A) is mainly configured by connecting a variable capacity compressor 1, a four-way reversing valve 2 which switches over refrigerant flowing directions of the heat source device, a heat source device heat exchanger 3, an accumulator 4, a heat source device switching valve 40, and a first circulating composition detecting device 50 through refrigerant pipes.

The heat source device heat exchanger 3 is configured by: a heat source device blower 20 which blows air, and in which the air blowing amount is variable; a first heat source device heat exchanger 41; a second heat source device heat exchanger 42 which is connected in parallel to the first heat source device heat exchanger 41, and which has the same heat transfer area as the first heat source device heat exchanger 41; a heat source device bypass pipe 43 which bypasses the two heat source device heat exchangers; a first electromagnetic control valve 44 disposed in a pipe through which the first heat source device heat exchanger 41 and the four-way reversing valve 2 are connected to each other; a second electromagnetic control valve 45 which is disposed on the side opposite the first electromagnetic control valve 44 across the first heat source device heat exchanger 41; a third electromagnetic control valve 46 disposed in a pipe through which the second heat source device heat exchanger 42 and the four-way reversing valve 2 are connected to each other; a fourth electromagnetic control valve 47 which is disposed on the side opposite the third electromagnetic control valve 46 across the second heat source device heat exchanger 42; and a fifth electromagnetic control valve 48 which is disposed in the middle of the heat source device bypass pipe 43. An air blow from the heat source blower 20 passes through the first heat source device heat exchanger 41 and the second heat source device heat exchanger 42 to perform heat exchange with a refrigerant flowing through the heat exchangers.

The heat source switching valve 40 is configured by: a second check valve 33 which is disposed between the heat source device (A) and a pipe connected to the relay device (F), or more specifically between one end of the four-way valve 2 and a first connecting pipe 6 that is thick, and that is connected to the relay device (F), and which allows the refrigerant to flow only from the first connecting pipe 6 to the four-way valve 2; a first check valve 32 which is disposed between the heat source device heat exchanger 3 and a second connecting pipe 7 (thinner than the first connecting pipe) connected to the relay device (F), and which allows the refrigerant to flow only from the heat source device heat exchanger 3 to the second connecting pipe 7; a third check valve 34 which allows the refrigerant to flow only from a pipe of the second check valve 33 on the side of the four-way valve 2, to that of the first check valve 32 on the side of the second connecting pipe 7; and a fourth check valve 35 which allows the refrigerant to flow only from a pipe of the second check valve 33 on the side of the first pipe 6, to that of the first check valve 32 on the side of the heat source device heat exchanger 3.

The first circulating composition detecting device 50 is an apparatus for detecting a refrigerant composition ratio of the refrigerant ejected from the compressor 1, and configured by: a bypass pipe 51 which bypasses ejection and suction pipes of the compressor 1; a first pressure reducing device 53 which is disposed in the middle of the bypass pipe 51; a fourth heat exchanging portion 52 in which the refrigerants in front and rear of the first pressure reducing device 53 perform heat exchange with each other; and first temperature detecting means 54 and second temperature detecting means 55 which detect temperatures in front and rear of the first pressure reducing device 53, respectively.

Fifth pressure detecting means 56 is disposed between the accumulator 4 and the compressor 1.

The standard indoor unit (B) is configured by: an indoor unit heat exchanger 5B; a first flow controller 9B which is in the vicinity of and connected to the indoor unit heat exchanger 5B, which, when the indoor unit heat exchanger 5B operates as an evaporator, is controlled by a superheat amount obtained by fourth temperature detecting means 27B and fifth temperature detecting means 28B that are disposed respectively in two ports (inlet and outlet) of the indoor unit heat exchanger, and which, when the indoor unit heat exchanger operates as a condenser, is controlled by a subcool amount; an indoor unit fan 36B which blows air to the indoor unit heat exchanger 5B; and humidity detecting means 58B and seventh temperature detecting means 60B which are disposed on the side of the air suction side of the indoor unit fan 36B.

The reheater (D) is configured by: a reheater heat exchanger 5D; and a first flow controller 9D which is in the vicinity of and connected to the reheater heat exchanger 5D, which, when the reheater heat exchanger 5D operates as an evaporator, is controlled by a superheat amount obtained by fourth temperature detecting means 27D and fifth temperature detecting means 28D that are disposed respectively in two ports of the reheater heat exchanger 5D, and which, when the reheater heat exchanger operates as a condenser, is controlled by a subcool amount.

The humidifier (G) has sixth temperature detecting means 59B.

The standard indoor unit (B), the reheater (D), and the humidifier (G) join together. The air blow from the indoor unit fan 36B passes through the indoor unit heat exchanger 5B to perform heat exchange with a refrigerant flowing through the indoor unit heat exchanger 5B, then passes through the reheater heat exchanger 5D to perform heat exchange with a refrigerant flowing through the reheater heat exchanger 5D, and is sent indoor after passing through the humidifier (G).

The standard indoor unit (C), the reheater (E), and the humidifier (H) are configured in the same manner as the standard indoor unit (B), the reheater (D), and the humidifier (G), respectively. Therefore, corresponding components are affixed by C, E, and H, and their detailed description is omitted.

One of refrigerant inlet/outlet ports of each of the indoor unit heat exchanger 5B, the indoor unit heat exchanger 5C, the reheater heat exchanger 5D, and the reheater heat exchanger 5E is connected to a first branching portion 10 of the relay device (F) through the first connecting pipe 6B, 6C, 6D, or 6E. The other one the refrigerant inlet/outlet ports is connected to a second branching portion 11 of the relay device (F) through the second connecting pipe 7B, 7C, 7D, or 7E via the first flow controller 9B, 9C, 9D, or 9E.

The first branching portion 10 has three-way reversing valves 8B, 8C, 8D, 8E in each of which a first port 8Ba, 8Ca, 8Da, or 8Ea is connected to the side of the second connecting pipe 7, a second port 8Bb, 8Cb, 8Db, or 8Eb is connected to the first connecting pipe 6, and a third port 8Bc, 8Cc, 8Dc, or 8Ec is connected to the first connecting pipe 6B, 6C, 6D, or 6E. The three-way reversing valves 8B, 8C, 8D, 8E enable connections of the first connecting pipes 6B, 6C, 6D, 6E to be switched to either of the first connecting pipe 6 and the second connecting pipe 7.

The relay device (F) has: a gas-liquid separator 12 which is disposed in the middle of the second connecting pipe 7, and in which the gas phase portion is connected to the first ports 8Ba, 8Ca, 8Da, 8Ea of the three-way reversing valves 8B, 8C, 8D, 8E, and the liquid phase is connected to the second branching portion 11; a second flow controller (in the embodiment, an electric expansion valve) 13 which is connected between the gas-liquid separator 12 and the second branching portion 11, and which is openable and closable; a bypass pipe 14 through which the second branching portion 11 is connected to the first connecting pipe 6; a third flow controller (in the embodiment, an electric expansion valve) 15 which is connected to the middle of the first bypass pipe 14; a fourth flow controller (in the embodiment, an electric expansion valve) 17 which is connected between the second branching portion 11 and the first connecting pipe 6, and which is openable and closable; a first heat exchanging portion 19 which performs heat exchange between the downstream side of the third flow controller 15 of the first bypass pipe 14 and a pipe connecting the gas-liquid separator 12 to the second flow controller 13; first pressure detecting means 25 which is disposed between the first branching portion 10 and the second flow controller 13; and second pressure detecting means 26 which is disposed between the second flow controller 13 and the fourth flow controller 17.

The second branching portion 11 has: a second heat exchanging portion 16A which is disposed upstream of the third flow controller 15 disposed in the middle of the first bypass pipe 14, and which performs heat exchange with junctions of the second connecting pipes 7B, 7C, 7D, 7E on the indoor unit/reheater side; and third heat exchanging portions 16B, 16C, 16D, 16E which are disposed downstream of the third flow controller 15 of the first bypass pipe 14, and which perform heat exchange with the second connecting pipes 7B, 7C, 7D, 7E on the indoor unit/reheater side, respectively.

In the air conditioning apparatus, also a control of calculating the composition ratio of refrigerants flowing into the reheater (condenser) in the case of a cooling-based humidity controlling operation from: a detection value of third temperature detecting means 57 disposed in the middle of a pipe which is between the first branching portion 10 or the second branching portion 11, and in which the pressure is high in the case of a cooling-based humidity controlling operation; a detection value of fourth pressure detecting means 18; and a detection value of the first circulating composition detecting device 50 is performed by a second circulating composition sensing device (not shown).

The air conditioning apparatus of FIG. 1 is charged with R407C that is a non-azeotropic mixture refrigerant in which, for example, R32/R125/R134a of HFC are mixed at a ratio of 23/25/52 wt %.

Although FIG. 1 comprises the humidifiers (G), (H), the humidifiers (G), (H) are not required in the case where only a dehumidifying operation is performed and a humidifying operation is not performed. In this case, the sixth temperature detecting means 59G, 59H are attached to the air blown out sides of the reheaters (D), (E).

Next, the behavior of the air conditioning apparatus shown in FIG. 1 will be described with reference to FIGS. 2 to 9.

Cooling Operation.

The behavior in the cooling operation will be described with reference to FIG. 2.

Figure 2:
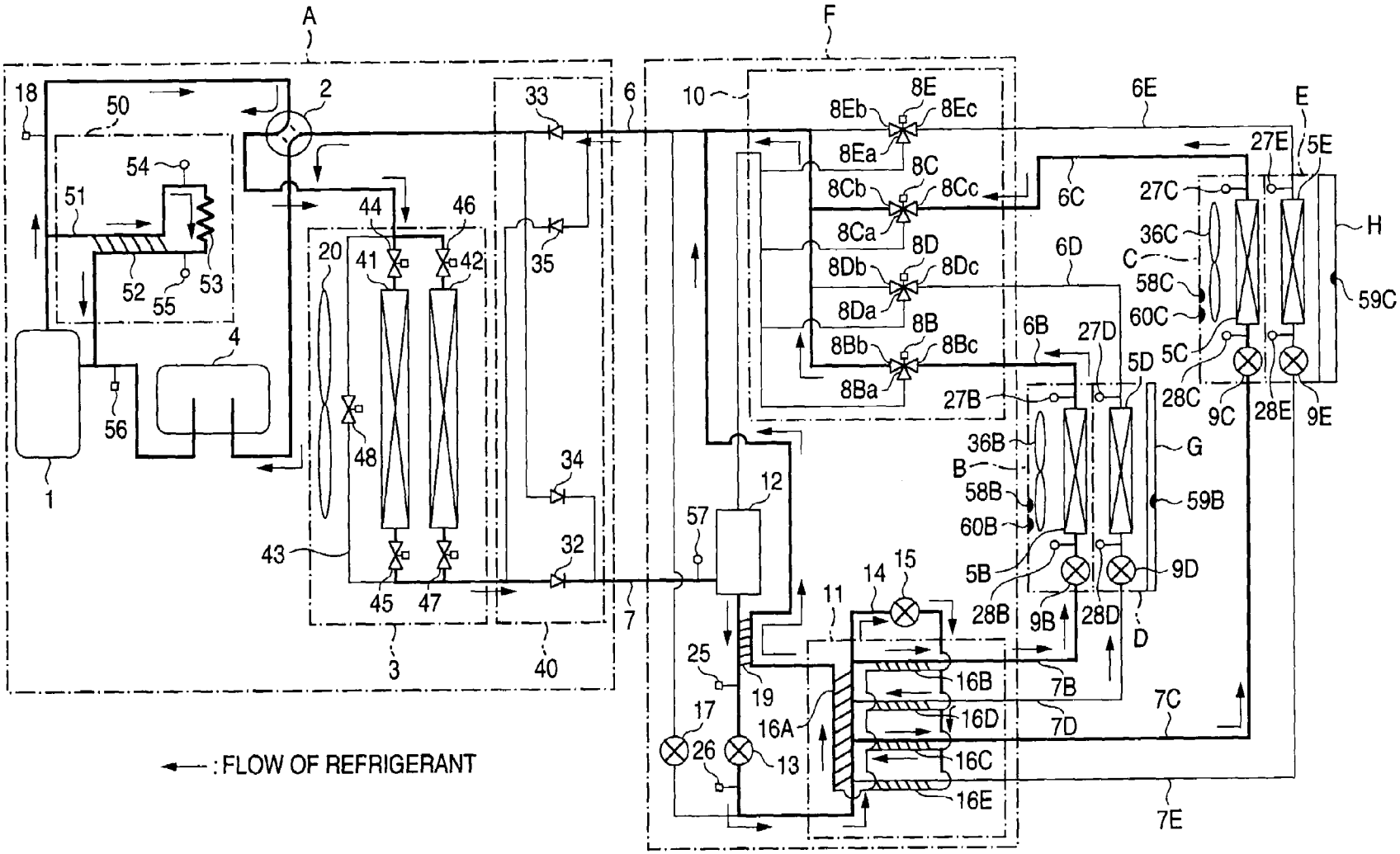
FIG. 2 is a diagram showing behavior of a cooling operation of Embodiment 1.

Referring to FIG. 2, as indicated by the solid arrows, the high-temperature and high-pressure gas refrigerant ejected from the compressor 1 passes through the four-way reversing valve 2, and, in the heat source device heat exchanger 3, performs heat exchange with air blown by the heat source device blower 20 in which the air blowing amount is variable, to be condensed and liquefied. Thereafter, the refrigerant passes through a sequence of the first check valve 32, the second connecting pipe 7, the gas-liquid separator 12, and the second flow controller 13, and further passes through the second branching portion 11 and the second connecting pipes 7B, 7C on the indoor unit side to flow into the standard indoor units (B), (C).

In the standard indoor units (B), (C), the pressure of the liquid refrigerant is reduced to a low pressure by the first flow controllers 9B, 9C which are controlled by the superheat amounts at the outlets of the indoor unit heat exchangers 5B, 5C. Thereafter, the liquid refrigerant flows flown into the indoor unit heat exchangers 5B, 5C to perform heat exchange with indoor air blown by the indoor unit fans 36B, 36C to be vaporized and gasified, thereby cooling the interiors of rooms. If the indoor air humidity sensed by the humidity detecting means 58B, 58C indicates a value which is smaller than a target value, the humidifier (G) or (H) operates to humidify the indoor air.

The refrigerant which has been set to the gaseous state in the indoor unit heat exchangers 5B, 5C is sucked into the compressor 1 through the first connecting pipe 6B, 6C, the three-way reversing valves 8B, 8C, the first connecting pipe 6, the fourth check valve 33, the four-way reversing valve 2 of the heat source device, and the accumulator 4. At this time, the first ports 8Ba, 8Ca of the three-way reversing valves 8B, 8C are closed, and the second ports 8Bb, 8Cb and the third ports 8Bc, 8Cc are opened. The first ports 8Da, 8Ea, second ports 8Db, 8Eb, and third ports 8Dc, 8Ec of the three-way reversing valves 8D, 8E are closed. Therefore, the refrigerant does not flow into the reheaters (D), (E).

Since the pressure of the first connecting pipe 6 is low and that of the second connecting pipe 7 is high, the refrigerant inevitably passes through the first check valve 32 and the second check valve 33.

In this cycle, part of the refrigerant which has passed through the second flow controller 13 enters the first bypass pipe 14, the pressure of the refrigerant is reduced to a low pressure by the third flow controller 15, and the refrigerant performs heat exchange with the second connecting pipes 7B, 7C in the third heat exchanging portions 16B, 16C, with the junctions of the second connecting pipes 7B, 7C, 7D, 7E in the second branching portion 11, and with the refrigerant flowing into the second flow controller 13 in the first heat exchanging portion 19, whereby the refrigerant is evaporated. The refrigerant then passes through the first connecting pipe 6 and the second check valve 33 to be sucked into the compressor 1 via the four-way reversing valve 2 and the accumulator 4.

By contrast, the refrigerant which has performed heat exchange in the first heat exchanging portion 19, the second heat exchanging portion 16A, and the third heat exchanging portions 16B, 16C to be cooled and sufficiently provided with subcool flows into the standard indoor units (B), (C) which are to perform a cooling operation. The capacity of the variable capacity compressor 1, and the air blowing amount of the heat source device blower 20 are adjusted so that the evaporation temperatures of the standard indoor units (B), (C), and the condensation temperature of the heat source device blower 20 reach predetermined target temperatures. As a result, a target cooling ability can be obtained in the standard indoor units (B), (C).

Figure 3:
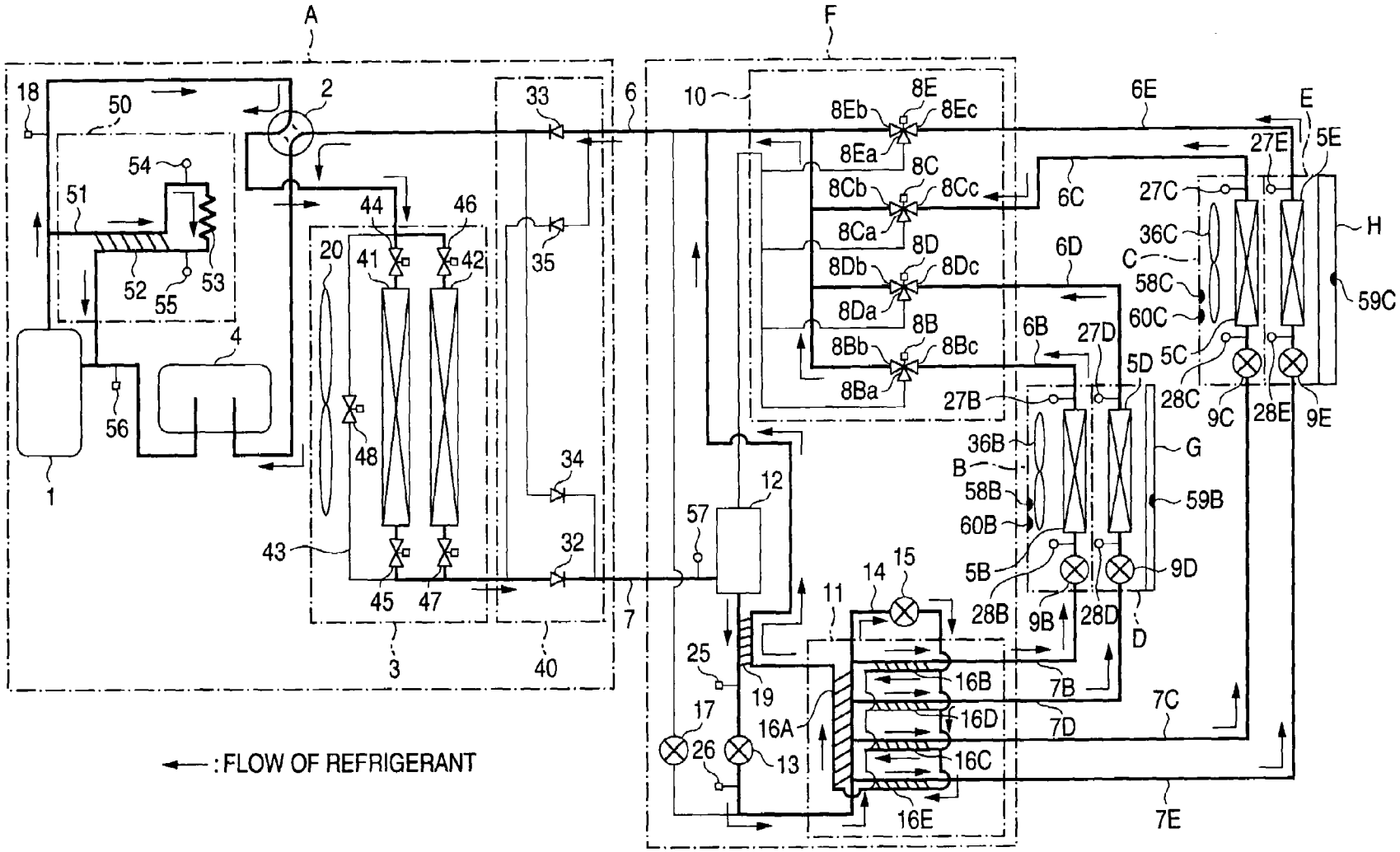
FIG. 3 is a diagram showing behavior of another cooling operation of Embodiment 1.

In addition to the cooling operation of FIG. 2, as shown in FIG. 3, the first ports 8Da, 8Ea of the three-way reversing valves 8D, 8E may be closed, and the second ports 8Db, 8Eb and the third ports 8Dc, 8Ec may be opened, so that the refrigerant flows into the reheaters (D) and (E), whereby the cooling ability is enhanced.

Heating Operation.

Next, the behavior in the heating operation will be described with reference to FIG. 4.

Figure 4:
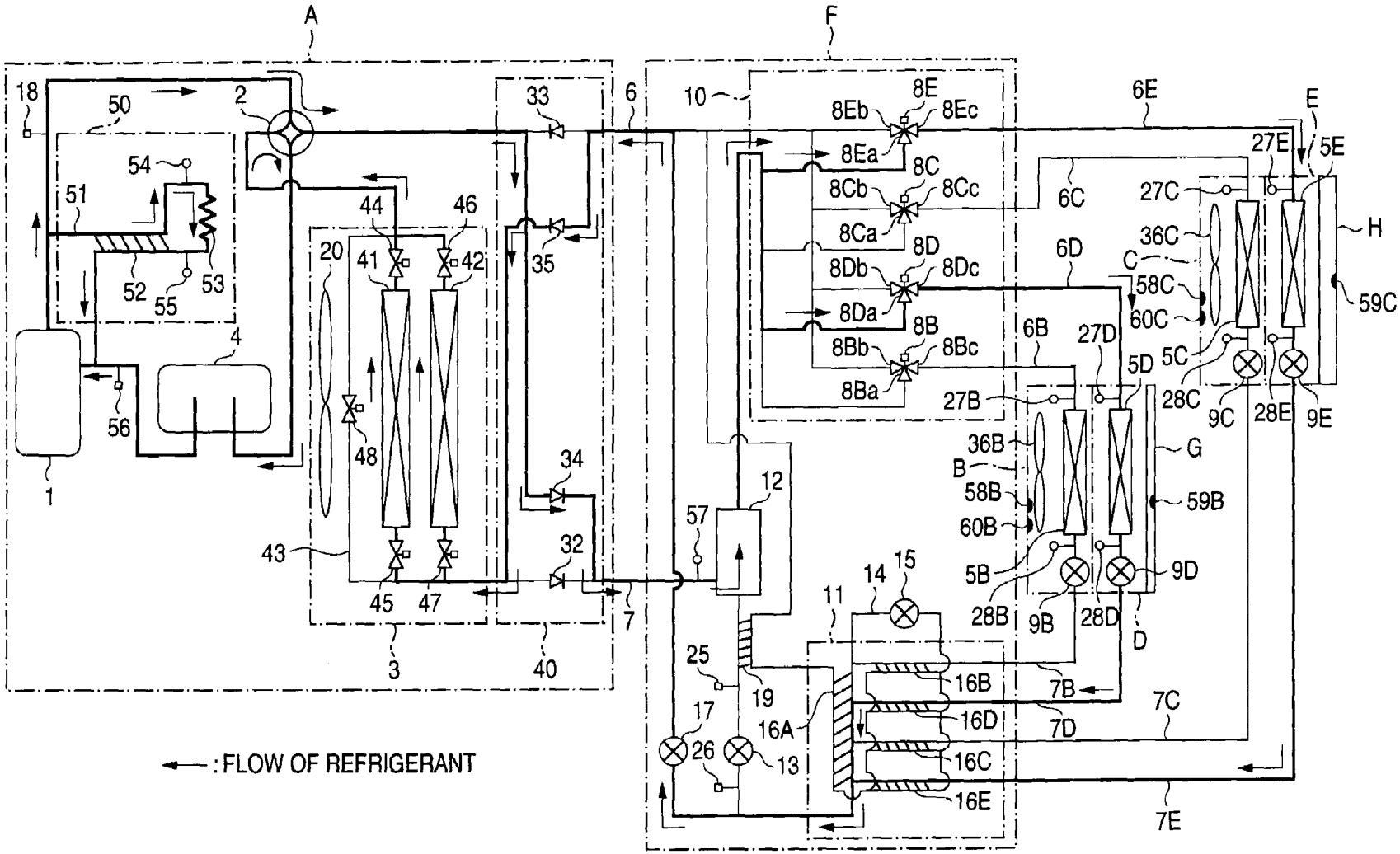
FIG. 4 is a diagram showing behavior of a heating operation of Embodiment 1.

Referring to FIG. 4, as indicated by the solid arrows, the high-temperature and high-pressure gas refrigerant ejected from the compressor 1 passes through the four-way reversing valve 2, passes through the third check valve 34, the second connecting pipe 7, and the gas-liquid separator 12, and passes through a sequence of the three-way reversing valves 8D, 8E and the first connecting pipes 6D, 6E to flow into the reheater heat exchangers 5D, 5E of the reheaters (D), (E). The refrigerant performs heat exchange with indoor air blown by the indoor fans 36B, 36C to be condensed and liquefied, thereby heating the interiors of rooms. If the indoor air humidity sensed by the humidity detecting means 58B, 58C indicates a value which is smaller than a target value, the humidifier (G) or (H) operates to humidify the indoor air.

The refrigerant which has been set to the condensed and liquidus state in the reheater heat exchangers 5D, 5E is controlled in the outlet subcool amounts of the reheater heat exchangers 5D, 5E, passes through the first flow controllers 9D, 9E, and then flows into the second branching portion 11 via the second connecting pipes 7D, 7E to join together. The joined refrigerant passes through the fourth flow controller 17 or the third flow controller 15. The pressure of the refrigerant which is condensed in the reheater heat exchangers 5D, 5E is reduced to a gas-liquid two phase of a lower pressure by the first flow controllers 9D, 9E, or the third flow controller 15, or the fourth flow controller 17. The refrigerant the pressure of which is reduced to a low pressure flows into the fourth check valve 35 of the heat source device (A) and the heat source device heat exchanger 3 via the first connecting pipe 6, and therein performs heat exchange with air blown by the heat source device blower 20 in which the air blowing amount is variable, to be evaporated to have a gaseous state. The gaseous refrigerant is sucked into the compressor 1 via the four-way reversing valve 2 and the accumulator 4.

At this time, in the three-way reversing valves 8D, 8E, the second ports 8Db, 8Eb are closed, and the first ports 8Da, 8Ea and the third ports 8Dc, 8Ec are opened. Since the pressure of the first connecting pipe 6 is low and that of the second connecting pipe 7 is high, the refrigerant inevitably passes through the third check valve 34 and the fourth check valve 35. The capacity of the variable capacity compressor 1, and the air blowing amount of the heat source device blower 20 are adjusted so that the condensation temperatures of the reheaters (D), (E), and the evaporation temperature of the heat source device blower 20 reach predetermined target temperatures. As a result, a target heating ability can be obtained in each of the indoor units.

Figure 5:
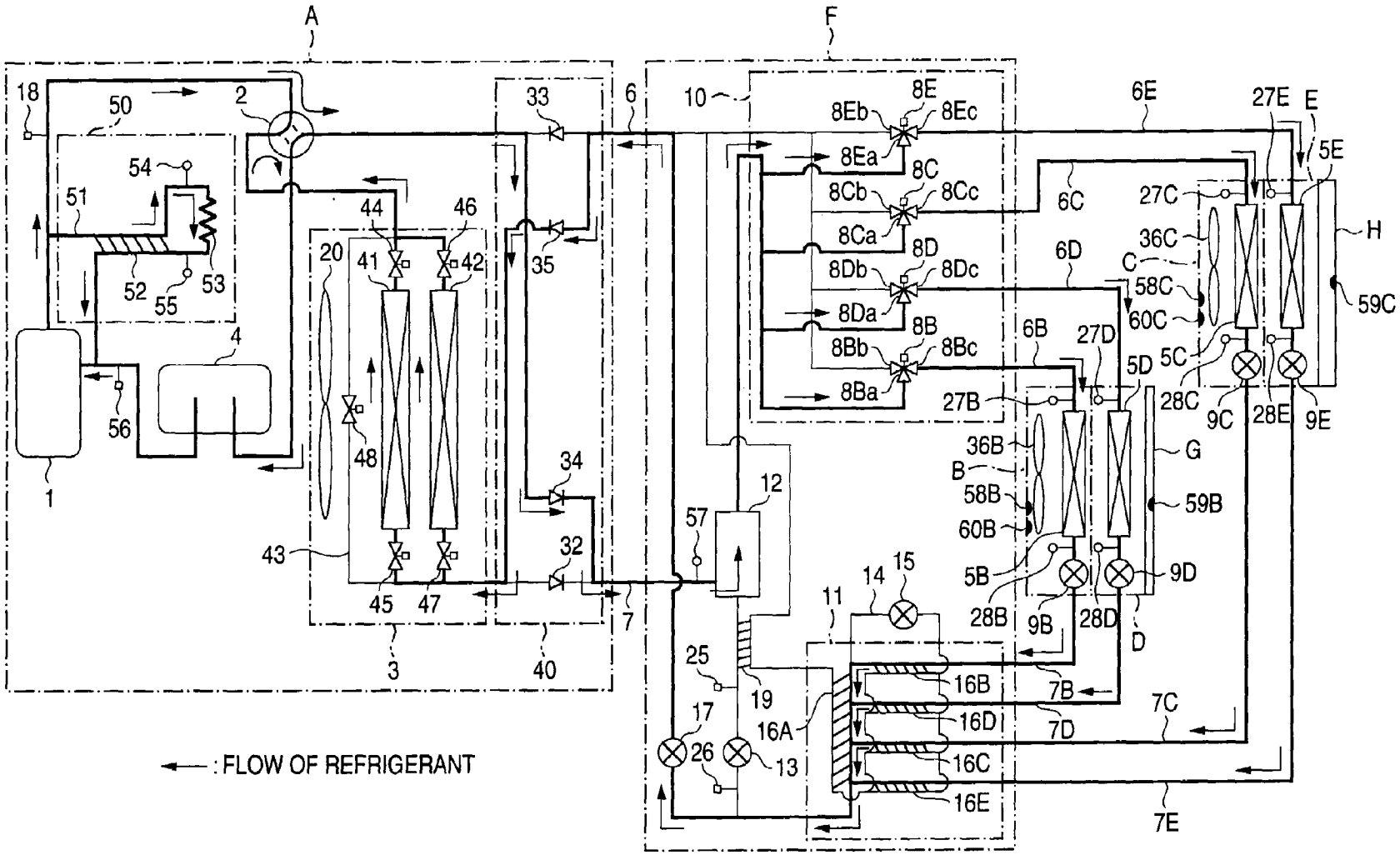
FIG. 5 is a diagram showing behavior of another heating operation of Embodiment 1.

In addition to the heating operation of FIG. 4, as shown in FIG. 5, the second ports 8Bb, 8Cb of the three-way reversing valves 8B, 8C may be closed, and the second ports 8Ba, 8Ca and the third ports 8Bc, 8Cc may be opened, so that the refrigerant flows through the standard indoor units (B), (C), whereby the heating ability is enhanced.

Heating-based humidity controlling operation (operation in which the heating (reheating) operation capacity is larger than the cooling (dehumidifying) operation capacity)

The behavior in the heating-based humidity controlling operation will be described with reference to FIG. 6.

Figure 6:
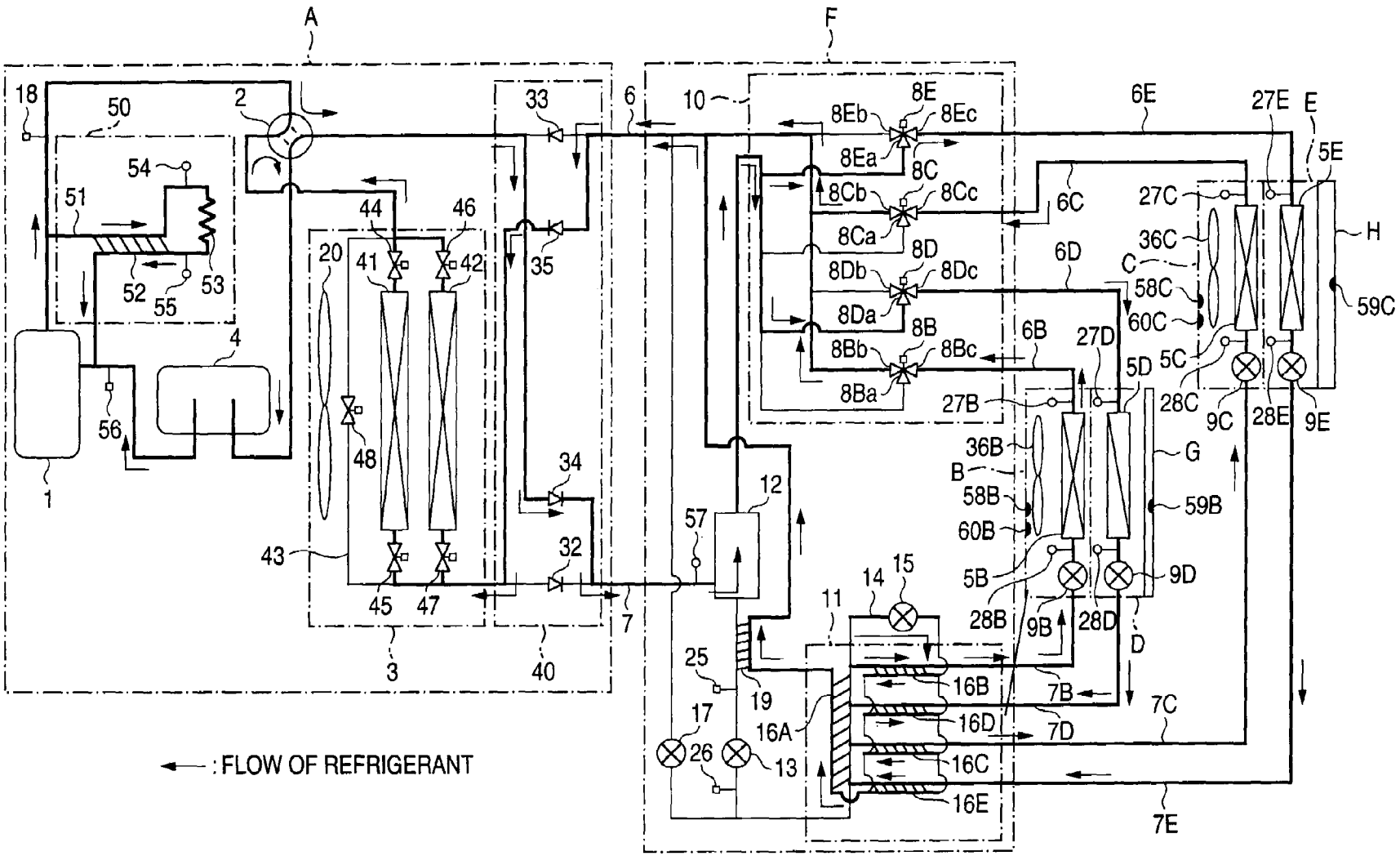
FIG. 6 is a diagram showing behavior of a heating-based humidity controlling operation of Embodiment 1.

Referring to FIG. 6, as indicated by the solid arrows, the high-temperature and high-pressure gas refrigerant ejected from the compressor 1 passes through the four-way reversing valve 2, the third check valve 34, the second connecting pipe 7, and the gas-liquid separator 12, and passes through the three-way reversing valves 8D, 8E, and the first connecting pipes 6D, 6E to flow into the reheaters (D), (E) which are to perform a heating operation. The refrigerant performs heat exchange with indoor air in the reheater heat exchangers 5D, 5E to be condensed and liquefied. The condensed and liquefied refrigerant is controlled in the outlet subcool amounts of the reheater heat exchangers 5D, 5E, passes through the first flow controllers 9D, 9E to be slightly reduced in pressure, and then enters the second branching portion 11 via the second connecting pipes 7D, 7E.

In the second branching portion 11, the liquid refrigerant sent from the second connecting pipes 7D, 7E joins together. Part of the joined refrigerant enters the standard indoor units (B), (C) through the second connecting pipes 7B, 7C, enters the first flow controllers 9B, 9C which are controlled by the superheat amounts at the outlets of the indoor unit heat exchangers 5B, 5C, to be reduced in pressure, and thereafter flows into the indoor unit heat exchangers 5B, 5C to be transferred from the liquidus state to the gaseous state by heat exchange, thereby dehumidifying and cooling the indoor air. The refrigerant flows into the first connecting pipe 6 via the three-way reversing valves 8B, 8C. The indoor air which is dehumidified and cooled by the standard indoor units (B), (C) is heated by the reheaters (D), (E), and then sent to the interiors of rooms. In this operation, the humidifiers (G), (H) do not operate, and hence the indoor air is not humidified.

On the other hand, the other refrigerant passes through the fourth flow controller 17 which is controlled so that the pressure difference between the detection output of the first pressure detecting means 25 and that of the second pressure detecting means 26 is within a predetermined range, joins with the refrigerant which has passed through the standard indoor unit (B) or (C) that is to dehumidify and cool the indoor air, and flows into the fourth check valve 35 and the heat source device heat exchanger 3 of the heat source device (A) via the thick first connecting pipe 6. In the heat exchanger, the refrigerant performs heat exchange with air blown by the heat source device blower 20 in which the air blowing amount is variable, to be transferred from the liquidus state to the gaseous state. The capacity of the variable capacity compressor 1, and the air blowing amount of the heat source device blower 20 are adjusted so that the evaporation temperatures of the standard indoor units (B), (C), and the condensation temperatures of the reheaters (D), (E) reach predetermined target temperatures, the first electromagnetic control valve 44, the second electromagnetic control valve 45, the third electromagnetic control valve 46, and the fourth electromagnetic control valve 47 which are at the both ends of the first heat source device heat exchanger 41 and the second heat source device heat exchanger 42 are opened or closed to adjust the heat transfer areas, and the electromagnetic control valve 48 of the heat source device bypass pipe 43 is opened or closed to adjust the flow amount of the refrigerant flowing through the first heat source device heat exchanger 41 and the second heat source device heat exchanger 42, whereby an arbitrary heat exchange amount can be obtained in the heat source device heat exchanger 3, a target dehumidifying/cooling ability can be obtained in each of the standard indoor units, and a target superheating ability can be obtained in each of the reheaters (in the case where the dehumidifying/cooling ability is to be larger than the superheating ability, however, the operation is switched to the cooling-based humidity controlling operation which will be described later).

Then, a circulation cycle in which the refrigerant is sucked into the compressor 1 via the four-way reversing valve 2 and the accumulator 4 of the heat source device (A) is configured, and the heating-based humidity controlling operation is performed.

At this time, the pressure difference between the evaporation pressures of the indoor heat exchangers 5B, 5C of the standard indoor units (B), (C) which perform the dehumidifying/cooling operation, and the heat source device heat exchanger 3 is reduced because of the switching to the thick first connecting pipe 6. The second ports 8Db, 8Eb of the three-way reversing valves 8D, 8E which are connected to the reheaters (D), (E) are closed, and the first ports 8Da, 8Ea and the third ports 8Dc, 8Ec are opened. The first ports 8Ba, 8Ca of the standard indoor units (B), (C) are closed, the second ports 8Bb, 8Cb and the third ports 8Bc, 8Cc are opened. At this time, the pressure of the first connecting pipe 6 is low and that of the second connecting pipe 7 is high, and therefore the refrigerant inevitably passes through the third check valve 34 and the fourth check valve 35.

In this cycle, part of the liquid refrigerant enters the first bypass pipe 14 from the junctions of the second connecting pipes 7B, 7C, 7D, 7E of the second branching portion 11, the pressure of the refrigerant is reduced to a low pressure by the third flow controller 15, and the refrigerant performs heat exchange with the second connecting pipes 7B, 7C, 7D, 7E of the second branching portion 11 in the third heat exchanging portions 16B, 16C, 16D, 16E, and with the junction of the second connecting pipes 7B, 7C, 7D, 7E and 7B, 7C, 7D, 7E of the second branching portion 11 in the second heat exchanging portion 16A, to be evaporated, and then enters the first connecting pipe 6 and the fourth check valve 35 to be sucked into the compressor 1 via the four-way reversing valve 2 and the accumulator 4 of the heat source device.

By contrast, the refrigerant of the second branching portion 11 which has performed heat exchange in the second heat exchanging portion 16A and the third heat exchanging portions 16B, 16C, 16D, 16E to be cooled and sufficiently provided with subcool flows into the standard indoor units (B), (C) which are to dehumidify/cool the indoor air.

Figure 7:
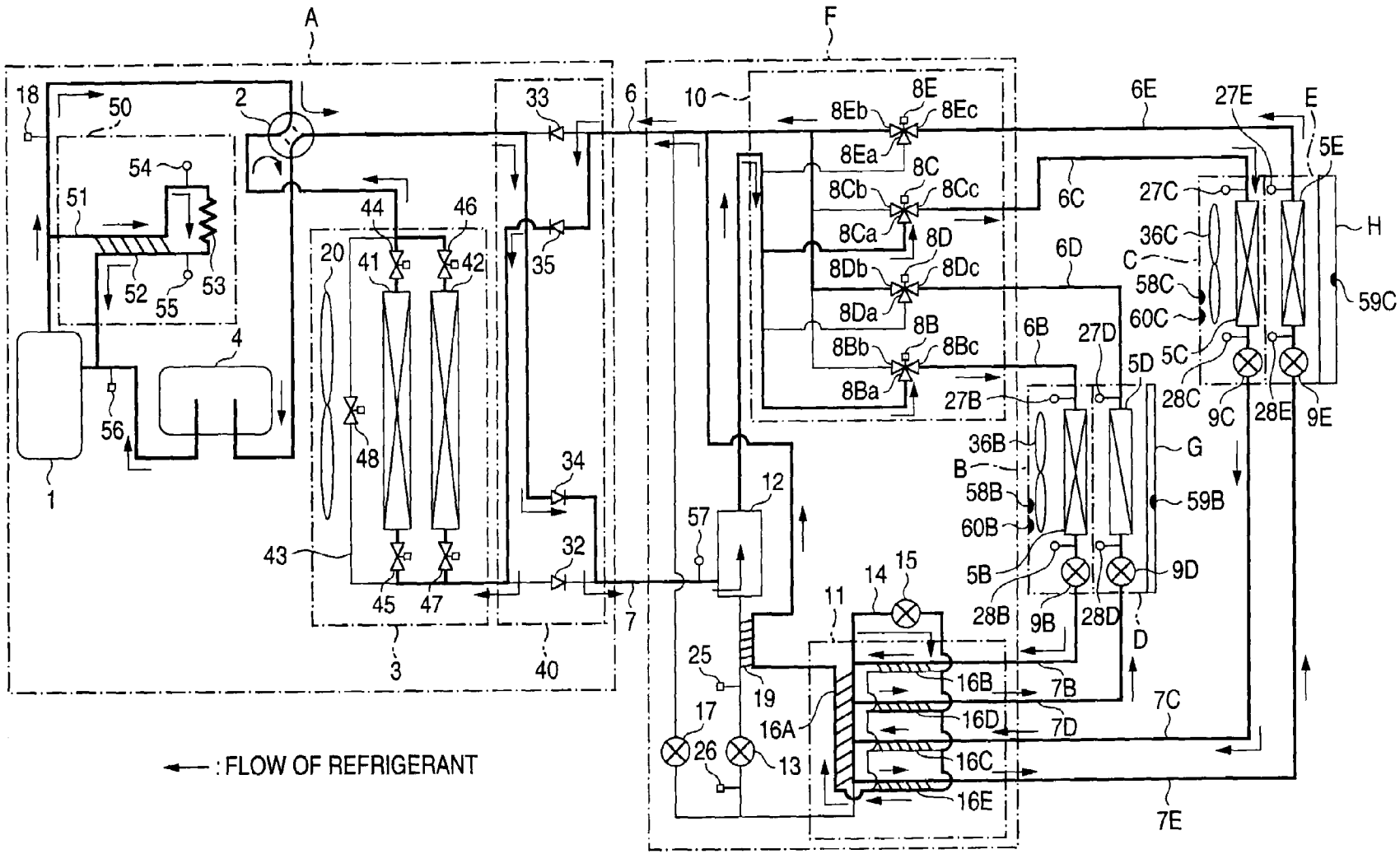
FIG. 7 is a diagram showing behavior of another heating-based humidity controlling operation of Embodiment 1.

In addition to the heating-based humidity controlling operation of FIG. 6, as shown in FIG. 7, the second ports 8Bb, 8Cb of the three-way reversing valves 8B, 8C may be closed, the second ports 8Ba, 8Ca and the third ports 8Bc, 8Cc may be opened, the first ports 8Da, 8Ea of the three-way reversing valves 8D, 8E may be closed, and the second ports 8Db, 8Eb and the third ports 8Dc, 8Ec may be opened, so that an operation in which the indoor unit heat exchangers 5B, 5C operate as condensers, and the reheater heat exchangers 5D, 5E operate as evaporators is performed, and the operation may be switched to the heating-based humidity controlling operation in the case of FIG. 7 in accordance with the target value of the humidity to be adjusted.

In FIG. 6, in the case where the indoor unit configured by the standard indoor unit (B), the reheater (D), and the humidifier (G) performs the heating-based humidity controlling operation, and the indoor unit configured by the standard indoor unit (C), the reheater (E), and the humidifier (H) performs a heating operation, for example, all the ports of the three-way reversing valve 8C are fully closed, so that the refrigerant does not flow into the standard indoor unit (C).

By contrast, in the case where the indoor unit configured by the standard indoor unit (C), the reheater (E), and the humidifier (H) performs a cooling operation, for example, all the ports of the three-way reversing valve 8E are fully closed, so that the refrigerant does not flow into the reheater (E).

Cooling-based humidity controlling operation (operation in which the cooling (dehumidifying) operation capacity is larger than the heating (reheating) operation capacity)

The behavior in the cooling-based humidity controlling operation will be described with reference to FIG. 8.

Figure 8:
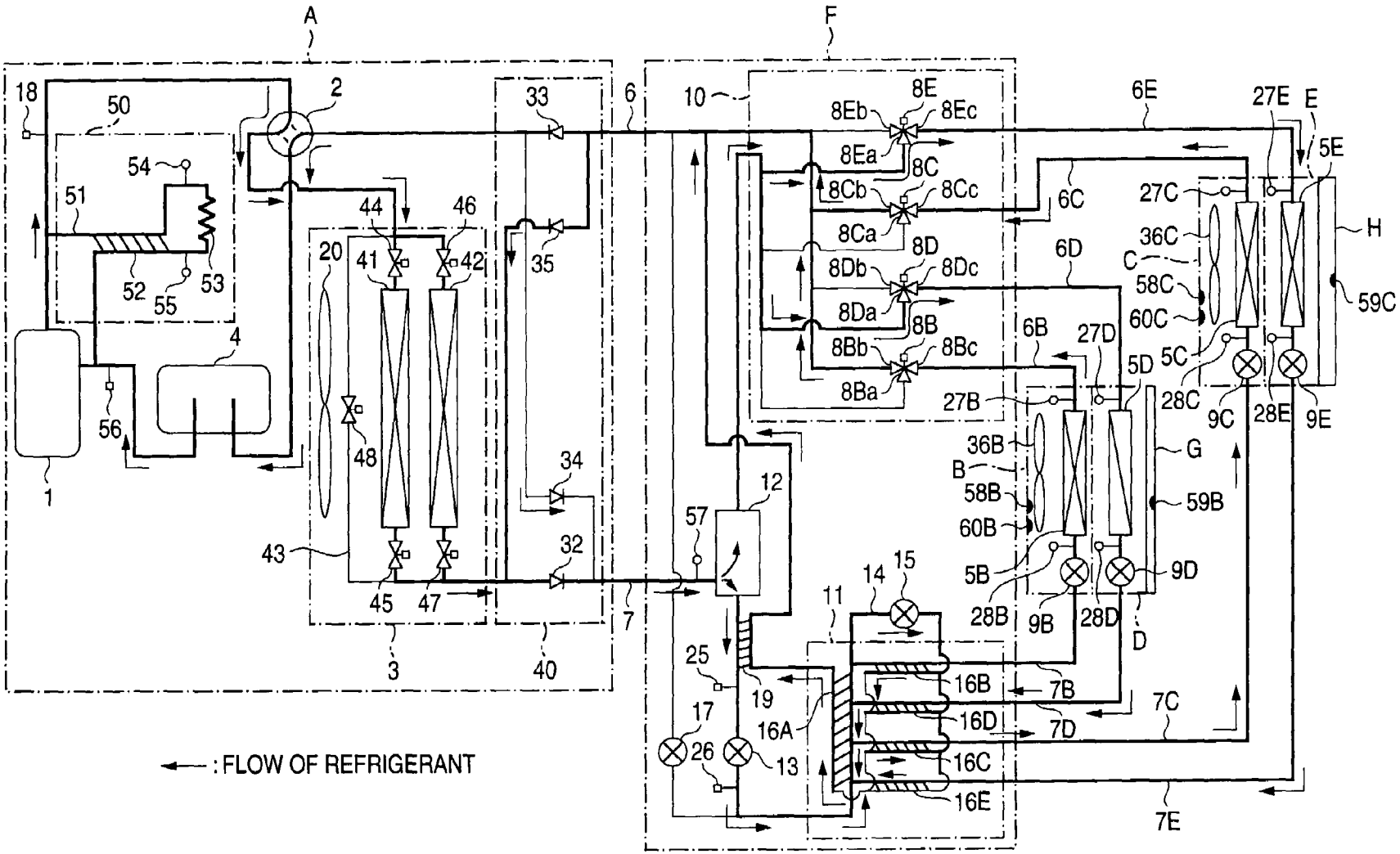
FIG. 8 is a diagram showing behavior of a cooling-based humidity controlling operation of Embodiment 1.

Referring to FIG. 8, as indicated by the solid arrows, the refrigerant gas ejected from the compressor 1 flows into the heat source device heat exchanger 3 via the four-way reversing valve 2, and therein performs heat exchange with the air blown by the heat source blower 20 in which the air blowing amount is variable, to have a two-phase high temperature and high pressure state. The capacity of the variable capacity compressor 1, and the air blowing amount of the heat source device blower 20 are adjusted so that the evaporation and condensation temperatures of the indoor units reach predetermined target temperatures, the first electromagnetic control valve 44, the second electromagnetic control valve 45, the third electromagnetic control valve 46, and the fourth electromagnetic control valve 47 which are at the both ends of the first heat source device heat exchanger 41 and the second heat source device heat exchanger 42 are opened or closed to adjust the heat transfer areas, and the electromagnetic control valve 48 of the heat source device bypass pipe 43 is opened or closed to adjust the flow amount of the refrigerant flowing through the first heat source device heat exchanger 41 and the second heat source device heat exchanger 42, whereby an arbitrary heat exchange amount can be obtained in the heat source device heat exchanger 3, a target dehumidifying/cooling ability can be obtained in each of the indoor units, and a target superheating ability can be obtained in each of the reheaters (in the case where the superheating ability is to be larger than the dehumidifying/cooling ability, however, the operation is switched to the heating-based humidity controlling operation which has been described above). Thereafter, the refrigerant of the two-phase high temperature and high pressure state is sent to the gas-liquid separator 12 of the relay device (F) via the first check valve 32 and the second connecting pipe 7, to be separated to a gaseous refrigerant and a liquidus refrigerant. The separated gas refrigerant passes through a sequence of the first branching portion 10, the three-way reversing valves 8D, 8E, and the first connecting pipes 6D, 6E, flows into the reheaters (D), (E) which are to perform a heating operation, and performs heat exchange with indoor air in the reheater heat exchangers 5D, 5E to be condensed and liquefied. The temperature of the air blown into the interiors of rooms is adjusted by the sixth temperature detecting means 59B, 59C, or the temperature of sucked air is adjusted by the seventh temperature detecting means 60B, 60C. The condensed and liquefied refrigerant is controlled by the outlet subcool amounts of the reheater heat exchangers 5D, 5E, passes through the first flow controllers 9D, 9E to be slight reduced in pressure, and then enters the second branching portion 11. Part of the liquid refrigerant passes through the second connecting pipes 7B, 7C to enter the standard indoor units (B), (C) which are to perform a cooling operation, enters the first flow controllers 9B, 9C which are controlled by the outlet superheat amounts of the indoor unit heat exchangers 5B, 5C, to be reduced in pressure, thereafter enters the indoor unit heat exchangers 5B, 5C to perform heat exchange to be transferred to the gaseous state, thereby dehumidifying and cooling the indoor air, and enters the first connecting pipe 6 via the three-way reversing valves 8B, 8C. The indoor air which is dehumidified and cooled by the standard indoor units (B), (C) is heated by the reheaters (D), (E) as described above, so that the indoor air temperature or the temperature of the air blown out from the reheaters is adjusted. In this operation, the humidifiers (G), (H) do not operate, and hence the indoor air is not humidified.

On the other hand, the liquid refrigerant which is separated by the gas-liquid separator 12 passes through the second flow controller 13 which is controlled by the detection pressure of the first pressure detecting means 25 and that of the second pressure detecting means 26, flows into the second branching portion (11), and joins with the refrigerant which has passed through the reheaters (D), (E) that are to perform a heating operation. Then, the refrigerant passes through a sequence of the second branching portion 11 and the second connecting pipes 7B, 7C on the side of the indoor units, and then enters the standard indoor units (B), (C). The pressure of the liquid refrigerant entering the standard indoor units (B), (C) is reduced to a low pressure by the first flow controllers 9B, 9C which are controlled by the outlet superheat amounts of the indoor unit heat exchangers 5B, 5C. The refrigerant performs heat exchange with the indoor air to be evaporated and gasified, thereby dehumidifying/cooling the indoor air. Furthermore, the refrigerant which has been set to the gaseous state constitutes a circulation cycle in which it passes through the first connecting pipe 6B, 6C, the three-way reversing valves 8B, 8C, and the first branching portion 10, and sucked into the compressor 1 via the first connecting pipe 6, the second check valve 33, and the four-way reversing valve 2 and the accumulator 4 of the heat source device (A), thereby performing the cooling-based humidity controlling operation. At this time, the first ports 8Ba, 8Ca of the three-way reversing valves 8B, 8C connected to the standard indoor units (B), (C) are closed, and the second ports 8Bb, 8Cb and the third ports 8Bc, 8Cc are opened. The second ports 8Db, 8Eb of the three-way reversing valves 8D, 8E connected to the reheaters (D), (E) are closed, and the first ports 8Da, 8Ea and the third ports 8Dc, 8Ec are opened. At this time, since the pressure of the first connecting pipe 6 is low and that of the second connecting pipe 7 is high, the refrigerant inevitably flows into the first check valve 32 and the second check valve 33.

Moreover, part of the refrigerant which has joined in the second branching portion 11 enters the first bypass pipe 14 from the junctions of the second connecting pipes 7B, 7C, 7D, 7E of the second branching portion 11, the pressure of the refrigerant is reduced to a low pressure by the third flow controller 15, and the refrigerant performs heat exchange with the junctions of the second connecting pipes 7B, 7C, 7D, 7E of the second branching portion 11 in the third heat exchanging portions 16B, 16C, 16D, 16E, with the junctions of the second connecting pipes 7B, 7C, 7D, 7E of the second branching portion 11 in the second heat exchanging portion 16A, and with the refrigerant flowing into the second flow controller 13 in the first heat exchanging portion 19, to be evaporated, and then enters the first connecting pipe 6 and the second check valve 33 to be sucked into the compressor 1 via the four-way reversing valve 2 and the accumulator 4 of the heat source device. By contrast, the refrigerant of the second branching portion 11 which has performed heat exchange in the first heat exchanging portion 19, the second heat exchanging portion 16A, and the third heat exchanging portions 16B, 16C, 16D, 16E to be cooled and sufficiently provided with subcool flows into the standard indoor units (B), (C) which are to perform a dehumidifying/cooling operation.

Figure 9:
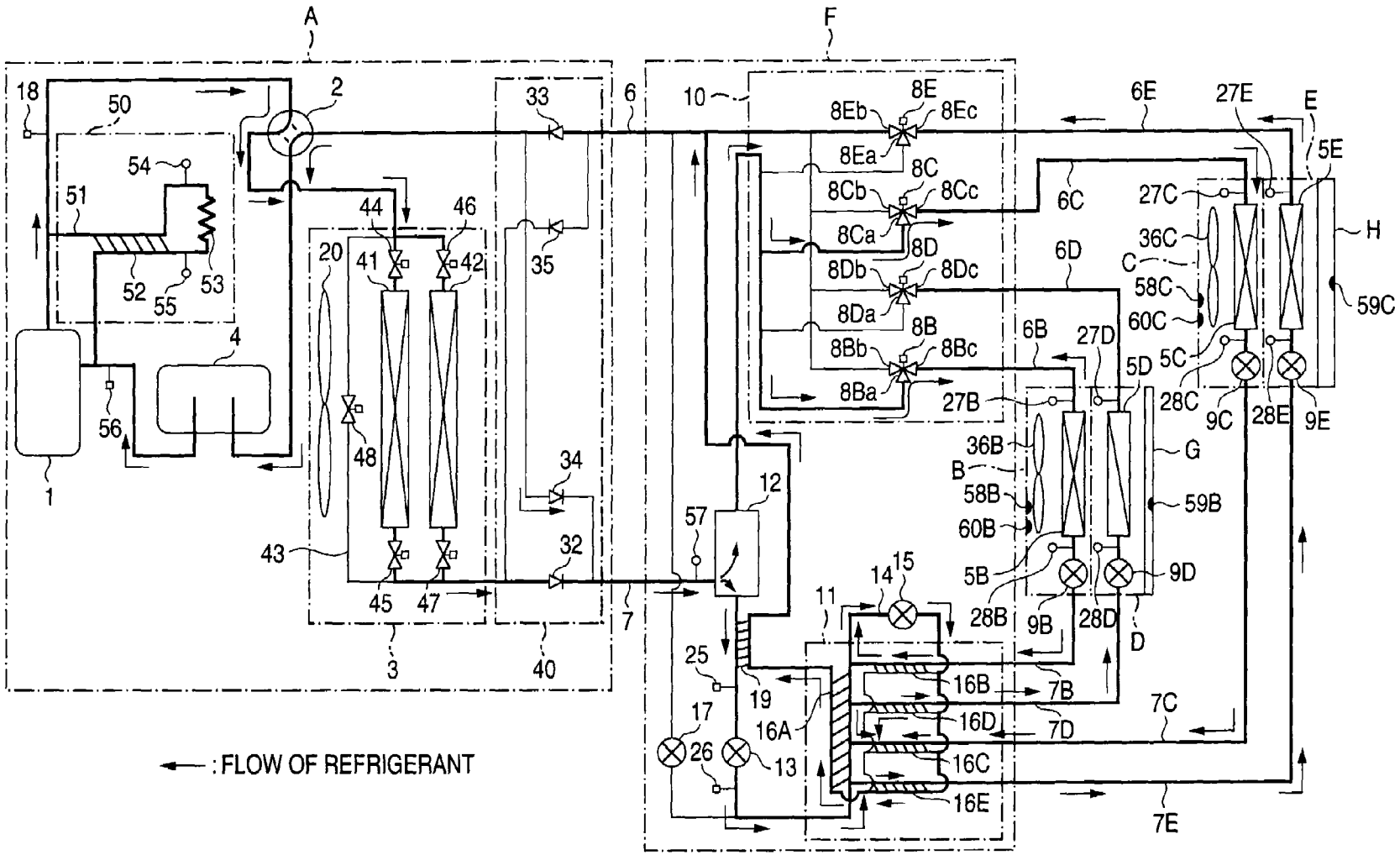
FIG. 9 is a diagram showing behavior of another cooling-based humidity controlling operation of Embodiment 1.

In addition to the cooling-based humidity controlling operation of FIG. 8, as shown in FIG. 9, the second ports 8Bb, 8Cb of the three-way reversing valves 8B, 8C may be closed, the second ports 8Ba, 8Ca and the third ports 8Bc, 8Cc may be opened, the first ports 8Da, 8Ea of the three-way reversing valves 8D, 8E may be closed, and the second ports 8Db, 8Eb and the third ports 8Dc, 8Ec may be opened, so that an operation in which the indoor unit heat exchangers 5B, 5C operate as condensers, and the reheater heat exchangers operate as evaporators is performed, and the operation may be switched to the cooling-based humidity controlling operation of FIG. 8 in accordance with the target value of the humidity to be adjusted.

In FIG. 8, in the case where the indoor unit configured by the standard indoor unit (B), the reheater (D), and the humidifier (G) performs the cooling-based humidity controlling operation, and the indoor unit configured by the standard indoor unit (C), the reheater (E), and the humidifier (H) performs a heating operation, for example, all the ports of the three-way reversing valve 8C are fully closed, so that the refrigerant does not flow into the standard indoor unit (C).

By contrast, in the case where the indoor unit configured by the standard indoor unit (C), the reheater (E), and the humidifier (H) performs a cooling operation, for example, all the ports of the three-way reversing valve 8E are fully closed, so that the refrigerant does not flow into the reheater (E).

As described above, each of plural indoor units can perform a cooling operation, a heating operation, or a temperature and humidity controlling operation, and therefore temperatures and humidities of plural rooms or places can be optimumly controlled.

Adjustment of a ratio of a low-boiling refrigerant and a high-boiling refrigerant.

Next, a ratio of a low-boiling refrigerant and a high-boiling refrigerant in the air conditioning apparatus will be described.

When one of a low-boiling refrigerant and a high-boiling refrigerant is known, the ratio of the low-boiling refrigerant and the high-boiling refrigerant can be known. Hereinafter, therefore, a ratio of a low-boiling refrigerant and a high-boiling refrigerant will be expressed as a refrigerant composition ratio.

In the case of a cooling operation, a heating operation, or a heating-based humidity controlling operation, the refrigerant is not separated to a gas phase and a liquid phase in the gas-liquid separator 12, and hence the refrigerants circulating in the refrigeration cycle, including the gas refrigerant in the accumulator 4 are refrigerants having the same refrigerant composition ratio. In the case where a heating operation is to be emphasized in a cooling and heating concurrent operation, the refrigerant is separated to a gas phase and a liquid phase in the gas-liquid separator 12, and, after the compressor 1, the refrigerants circulating in the refrigeration cycle, including the gas refrigerant in the accumulator 4 are therefore refrigerants having the same refrigerant composition ratio. In the case of a cooling operation, namely, the gas refrigerant in the accumulator 4, that ejected from the compressor 1, the gas-liquid two-phase refrigerant in the gas-liquid separator 12, and the gas refrigerants at the outlets of the standard indoor units (B), (C) have the same refrigerant composition ratio.

In the case of a heating operation, the gas refrigerant in the accumulator 4, that ejected from the compressor 1, and the liquid refrigerants at the outlets of the reheaters (D), (E) have the same refrigerant composition ratio.

In the case of a heating-based humidity controlling operation, the gas refrigerant ejected from the compressor 1, the gas-liquid two-phase refrigerant in the gas-liquid separator 12, the liquid refrigerant at the outlets of the reheaters (D), (E) which are to perform a superheating operation, and the gas refrigerants at the outlets of the standard indoor units (B), (C) which are to perform a dehumidifying/cooling operation have the same refrigerant composition ratio.

In the case of a cooling-based humidity controlling operation, with respect to the refrigerant composition ratio of the gas refrigerant ejected from the compressor 1, the gas-liquid two-phase refrigerant in the gas-liquid separator 12 is separated to a liquid refrigerant and a gas refrigerant, the gas refrigerant leaving from the gas-liquid separator 12 has a refrigerant composition ratio in which the ratios of low-boiling components R32, R125 are larger than those in the refrigerant composition ratio at the ejection port of the compressor 1, and flows into the reheaters (D), (E) which are to perform a superheating operation, and the refrigerant leaving from the reheaters (D), (E) and the liquid refrigerant leaving from the gas-liquid separator 12 join with a refrigerant composition ratio in which the ratio of a high-boiling component R134a is large to have the same refrigerant composition ratio as the gas refrigerant ejected from the compressor 1, and flows into the standard indoor units (B), (C) which are to perform a dehumidifying/cooling operation.

On the other hand, when the gas and liquid refrigerants in the accumulator 4 are considered, a gas-liquid equilibrium relationship is established in the accumulator 4. When a gas-liquid equilibrium is established in a non-azeotropic mixture refrigerant, the gas is a refrigerant which contains larger amounts of low-boiling components than the liquid. Therefore, the gas refrigerant in the accumulator 4 is a refrigerant which contains larger amounts of low-boiling refrigerants R32, R125 than the liquid refrigerant. By contrast, the liquid refrigerant in the accumulator 4 is a refrigerant which contains a larger amount of a high-boiling refrigerant R134a than the gas refrigerant. All the refrigerants in the air conditioning apparatus are refrigerants which are obtained by combining the refrigerant circulating in the air conditioning apparatus with the liquid refrigerant in the accumulator 4, and the refrigerant composition ratio of the combined refrigerants is identical with that of the charging refrigerant R407C. In the case where a liquid refrigerant exists in the accumulator 4, therefore, the refrigerants circulating in the refrigeration cycle of FIG. 1, including the gas refrigerant in the accumulator 4 are refrigerants which contain larger amounts of low-boiling refrigerants R32, R125 than the charging refrigerant, and the liquid refrigerant in the accumulator 4 is a refrigerant which contains a larger amount of the high-boiling refrigerant R134a than the composition of the charging refrigerant R407C. In the case where a liquid refrigerant does not exist in the accumulator 4, the refrigerant composition ratio of the refrigerants circulating in the air conditioning apparatus of FIG. 1 is identical with that of R407C.

Next, the function of the first circulating composition detecting device 50 will be described.

The high-pressure gas refrigerant leaving the compressor 1 passes through the second bypass pipe 51, performs heat exchange with the low-pressure refrigerant in the fourth heat exchanging portion 52 to be liquefied, and then reduced in pressure in the first pressure reducing device 53 to become a low-pressure two-phase refrigerant. Thereafter, the refrigerant performs heat exchange with the high-pressure refrigerant in the fourth heat exchanging portion 52 to be evaporated and gasified, and then returns to the suction of the compressor 1. In this device, the first temperature detecting means 54 detects the temperature of the liquid refrigerant, the second temperature detecting means 55 and the fifth pressure detecting means 56 detect the temperature and pressure of the two-phase refrigerant (the outlet pressure of the first pressure reducing device 53 is set as the value of the fifth pressure detecting means 56 because the value of the fifth pressure detecting means 56 and the outlet pressure of the first pressure reducing device 53 are substantially equal to each other), and, on the basis of the temperatures and the pressure, the refrigerant circulating composition of the non-azeotropic mixture refrigerant in the refrigerating apparatus is calculated and detected. The sensing of the circulating composition is always performed during a period when the power supply of the refrigerating air conditioning apparatus is turned ON.

The method of calculating the refrigerant circulating composition will be described. R407C is a ternary non-azeotropic refrigerant, and the refrigerant circulating compositions of the three kinds are unknown. When three equations are set and the equations are solved, therefore, the unknown circulating compositions can be known. When the refrigerant circulating compositions of the three kinds are added to one another, however, the addition result is 1. When R32 is indicated by α32, R125 by α125, and R134a by α134a, therefore, the following is always held:

$$\alpha 32+\alpha 125+\alpha 134a=1 \qquad \text{Exp. (1)}$$

Consequently, two equations (excluding α32+α125+α134a=1 above) are set for unknown circulating compositions of the two kinds, and the equations are solved, so that the circulating compositions can be known. When two equations in which α32 and α125 are unknown can be set, for example, circulating compositions can be known.

Next, the manner of setting equations in which α32 and α125 are unknown will be described.

Figure 10:
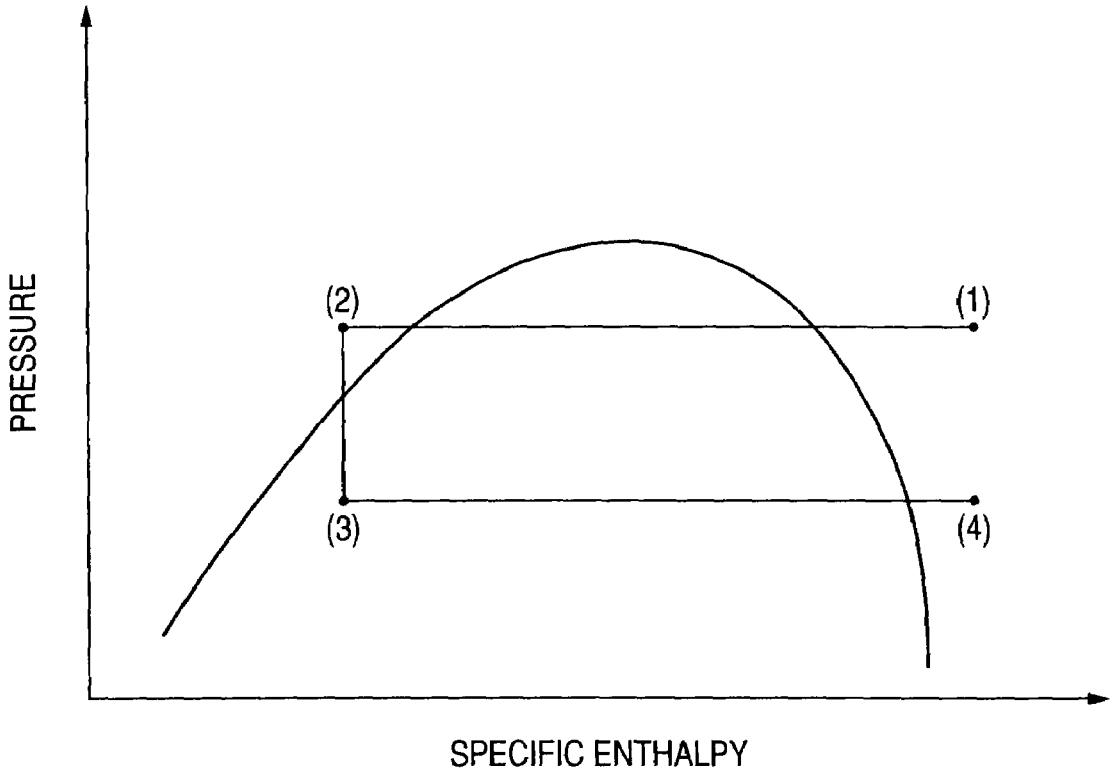
FIG. 10 is a view showing a state change of a refrigerant in a first circulating composition detecting device.

The first equation can be set from the first circulating composition detecting device 50. FIG. 10 is a Mollier chart showing a state change of the refrigerant in the first circulating composition detecting device 50. In FIG. 10, (1) shows a state of the high-pressure gas refrigerant emerging from the compressor 1, (2) shows a state where the refrigerant performs heat exchange with the low-pressure refrigerant in the fourth heat exchanging portion 52 to be liquefied, (3) shows a state where the refrigerant is reduced in pressure in the first pressure reducing device 53 to become a low-pressure two-phase refrigerant, and (4) shows a state where the refrigerant performs heat exchange with the high-pressure refrigerant in the fourth heat exchanging portion 52 to be evaporated and gasified. In FIG. 10, (2) and (3) have the same enthalpy. Therefore, it is possible to set an equation in which α32 and α125 are unknown, and which indicates that the enthalpy of (2) is equal to that of (3). When the enthalpy of (2) is indicated by hl, the enthalpy of (3) is indicated by ht, the temperature of the first temperature detecting means (54) is indicated by T11, the temperature of the second temperature detecting means 55 is indicated by T12, and the pressure of the fifth pressure detecting means 56 is indicated by P13, the following can be set $$hl(\alpha 32,\alpha 125,T11)=ht(\alpha 32,\alpha 125,T12,P13) \qquad \text{Exp. (2)}$$

In the second equation, as afar as the composition of the initial charging in the refrigerating apparatus is R407C, the gas-liquid equilibrium is held, and there is a constant relationship among components of the circulating composition even after liquid stays in the accumulator or the refrigerant leaks. When A and B are constants, the following empirical formula of gas-liquid equilibrium compositions can be set:

$$\alpha 32=A\times\alpha 125+B \qquad \text{Exp. (3)}$$

When Exps. (2) and (3) which are set as described above are solved, α32, α125, and α134a can be known. When the value of one composition in the three components of the circulating composition is known, the values of the other compositions can be known from the expression of α32=A×α25+B, and that of α32+α125+α134a=1.

Next, the function of the second circulating composition detecting device will be described.

Figure 11:
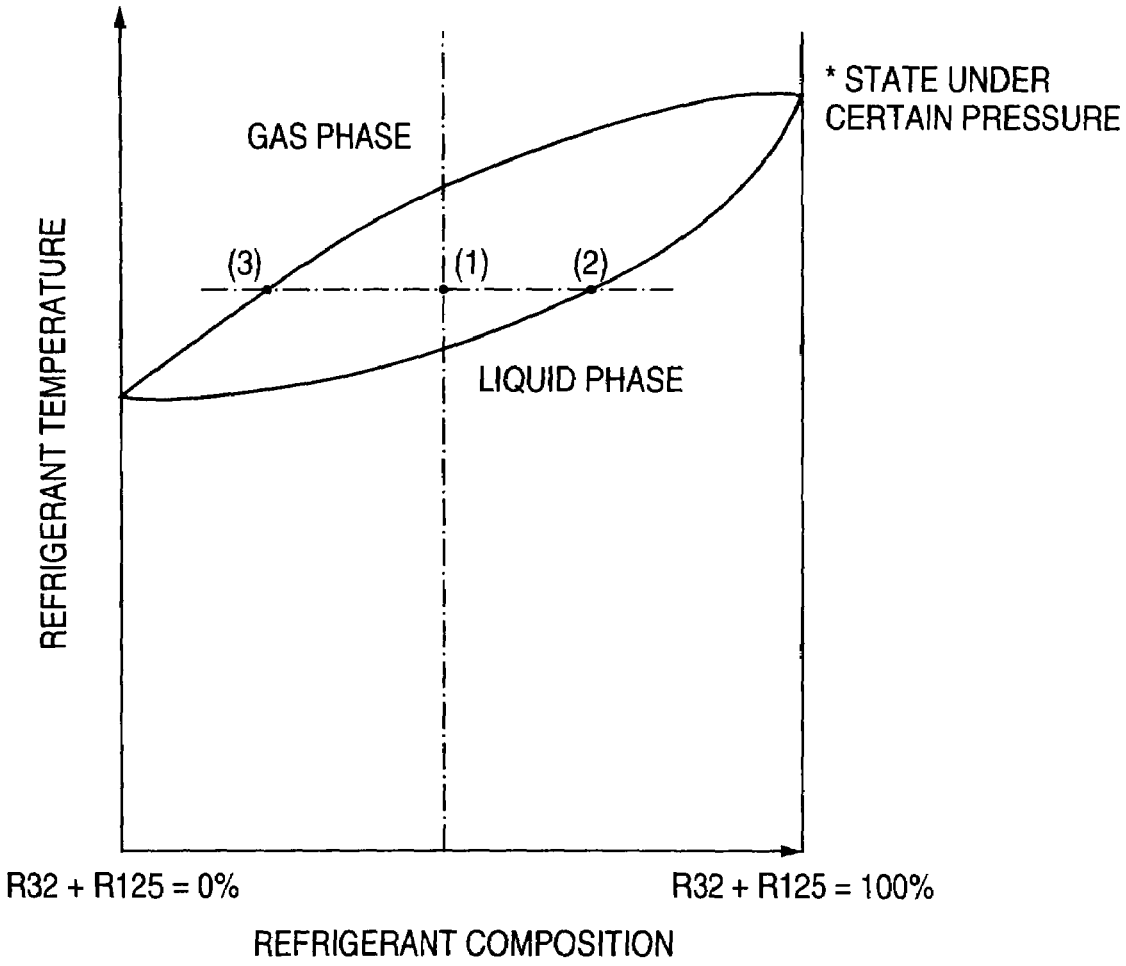
FIG. 11 is a view showing a state change of a refrigerant in a second circulating composition detecting device.

First, the refrigerant which flows into the gas-liquid separator 12 in the case of a cooling-based humidity controlling operation is identical with the refrigerant composition ratio detected by the first circulating composition detecting device 50. In the case of this operation, the flowing refrigerant is in the gas-liquid two-phase state. When the detection values of the third temperature detecting means 57 and the fourth pressure detecting means 18 are detected as the temperature and pressure of the gas-liquid separator 12, therefore, the gas-liquid equilibrium relationship such as shown in FIG. 11 can be obtained from the values. As the refrigerant composition ratio of the refrigerant flowing into the gas-liquid separator 12, the refrigerant composition ratio detected by the first circulating composition detecting device 50 is known. When it is assumed that the value is R32:R125:R134a=25%:27%:48% (in the state of (1) in FIG. 11), for example, the refrigerant composition ratio of the separated gas refrigerant can be therefore calculated as R32:R125:R134a=30%:32%:38% (the state of (2) in FIG. 11), and the refrigerant composition ratio of the separated liquid refrigerant can be calculated as R32: R125: R134a=20%:22%:48% (the state of (3) in FIG. 11). As a result, it is possible to detect the refrigerant composition ratio of the gas refrigerant flowing into the reheaters (the state of (2) in FIG. 11).

From the detection value of the first circulating composition detecting device 50, the composition ratio of the refrigerants flowing into the reheaters in the case of a cooling-based humidity controlling operation is calculated. In a normal cooling operation, a normal heating operation, and a heating-based humidity controlling operation, the detection value of the second circulating composition detecting device is identical with that of the first circulating composition detecting device 50.

Next, the method of calculating the evaporation temperature or the condensation temperature in the case where the evaporation temperatures or condensation temperatures of the indoor unit heat exchangers 5B, 5C, the reheater heat exchangers 5D, 5E, and the heat source device heat exchanger 3 are controlled to target temperatures will be described.

First, in the case of a normal cooling operation, the evaporation temperatures of the indoor unit heat exchangers 5B, 5C or the reheater heat exchangers 5D, 5E are calculated as a saturation temperature (liquid saturation temperature) at the detection pressure of the fifth pressure detecting means 56 in accordance with the detection pressure of the fifth pressure detecting means 56 and the refrigerant composition ratio detected by the first circulating composition detecting device 50, and the condensation temperature of the heat source device heat exchanger 3 is calculated as a saturation temperature (an average of the liquid saturation temperature and the gas saturation temperature) at the detection pressure of the fifth pressure detecting means 56 in accordance with the detection pressure of the fourth pressure detecting means 18 and the refrigerant composition ratio detected by the first circulating composition detecting device 50. The capacity of the variable capacity compressor 1, and the air blowing amount of the heat source device blower 20 are adjusted so that the temperatures reach the predetermined target temperatures, respectively.

However, the value detected by the second temperature detecting means 55 may be used as the saturation temperature (liquid saturation temperature) at the detection pressure of the fifth pressure detecting means 56, and calculated in accordance with the detection pressure of the fifth pressure detecting means 56 and the refrigerant composition ratio detected by the first circulating composition detecting device 50.

In the case of a normal heating operation, the evaporation temperature of the heat source device heat exchanger 3 is calculated as a saturation temperature (liquid saturation temperature) at the detection pressure of the fifth pressure detecting means 56 in accordance with the detection pressure of the fifth pressure detecting means 56 and the refrigerant composition ratio detected by the first circulating composition detecting device 50, and the condensation temperatures of the reheater heat exchangers 5D, 5E or the indoor unit heat exchangers 5B, 5C are calculated as a saturation temperature (an average of the liquid saturation temperature and the gas saturation temperature) at the detection pressure of the fourth pressure detecting means 18 in accordance with the detection pressure of the fourth pressure detecting means 18 and the refrigerant composition ratio detected by the first circulating composition detecting device 50. Then, the capacity of the variable capacity compressor 1, and the air blowing amount of the heat source device blower 20 are adjusted so that the temperatures reach the predetermined target temperatures, respectively.

In the case of a heating-based humidity controlling operation, the evaporation temperatures of the indoor unit heat exchangers 5B, 5C which are to perform a cooling operation are calculated as a saturation temperature (liquid saturation temperature) at the detection pressure of the fifth pressure detecting means 56 in accordance with the detection pressure of the fifth pressure detecting means 56 and the refrigerant composition ratio detected by the first circulating composition detecting device 50, and the condensation temperatures of the reheater heat exchangers 5D, 5E which are to perform a reheating operation are calculated as a saturation temperature (an average of the liquid saturation temperature and the gas saturation temperature) at the detection pressure of the fourth pressure detecting means 18 in accordance with the detection pressure of the fourth pressure detecting means 18 and the refrigerant composition ratio detected by the first circulating composition detecting device 50. Then, the capacity of the variable capacity compressor 1, and the air blowing amount of the heat source device blower 20 are adjusted so that the temperatures reach the predetermined target temperatures, respectively, the first electromagnetic control valve 44, the second electromagnetic control valve 45, the third electromagnetic control valve 46, and the fourth electromagnetic control valve 47 which are at the both ends of the first heat source device heat exchanger 41 and the second heat source device heat exchanger 42 are opened or closed to adjust the heat transfer areas, and the electromagnetic control valve 48 of the heat source device bypass pipe 43 is opened or closed to adjust the flow amount of the refrigerant flowing through the first heat source device heat exchanger 41 and the second heat source device heat exchanger 42.

However, the value detected by the second temperature detecting means 55 may be used as the saturation temperature (liquid saturation temperature) at the detection pressure of the fifth pressure detecting means 56, and calculated in accordance with the detection pressure of the fifth pressure detecting means 56 and the refrigerant composition ratio detected by the first circulating composition detecting device 50.

However, the value detected by the second temperature detecting means 55 may be used as the saturation temperature (liquid saturation temperature) at the detection pressure of the fifth pressure detecting means 56, and calculated in accordance with the detection pressure of the fifth pressure detecting means 56 and the refrigerant composition ratio detected by the first circulating composition detecting device 50.

In the case of a cooling-based humidity controlling operation, the evaporation temperatures of the indoor unit heat exchangers 5B, 5C which are to perform a cooling operation are calculated as a saturation temperature (liquid saturation temperature) at the detection pressure of the fifth pressure detecting means 56 in accordance with the detection pressure of the fifth pressure detecting means 56 and the refrigerant composition ratio detected by the first circulating composition detecting device 50, and the condensation temperatures of the reheater heat exchangers 5D, 5E which are to perform a reheating operation are calculated as a saturation temperature (an average of the liquid saturation temperature and the gas saturation temperature) at the detection pressure of the fourth pressure detecting means 18 in accordance with the detection pressure of the fourth pressure detecting means 18 and the refrigerant composition ratio detected by the second circulating composition detecting device. Then, the capacity of the variable capacity compressor 1, and the air blowing amount of the heat source device blower 20 are adjusted so that the temperatures reach the predetermined target temperatures, respectively, the first electromagnetic control valve 44, the second electromagnetic control valve 45, the third electromagnetic control valve 46, and the fourth electromagnetic control valve 47 which are at the both ends of the first heat source device heat exchanger 41 and the second heat source device heat exchanger 42 are opened or closed to adjust the heat transfer areas, and the electromagnetic control valve 48 of the heat source device bypass pipe 43 is opened or closed to adjust the flow amount of the refrigerant flowing through the first heat source device heat exchanger 41 and the second heat source device heat exchanger 42.

However, the value detected by the second temperature detecting means 55 may be used as the saturation temperature (liquid saturation temperature) at the detection pressure of the fifth pressure detecting means 56, and calculated in accordance with the detection pressure of the fifth pressure detecting means 56 and the refrigerant composition ratio detected by the first circulating composition detecting device 50.

Control System.

Figure 12:
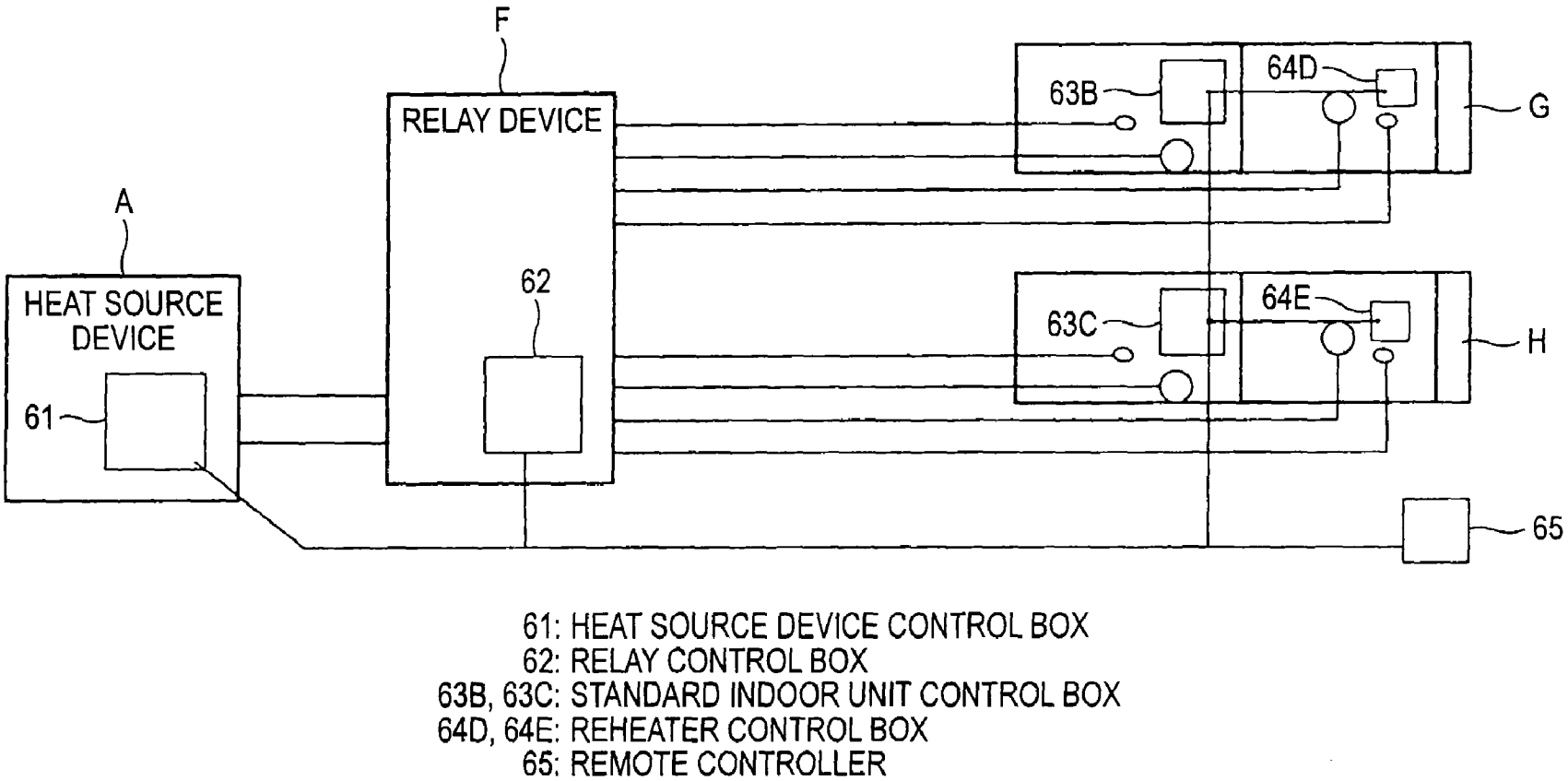
FIG. 12 is a diagram showing a control system.

Next, the control system of the air conditioning apparatus will be described with reference to the control system diagram of FIG. 12, and the indoor unit diagram of FIG. 13.

The heat source device (A) is connected to the relay device (F) through two pipes, and the relay device (F) is connected to the standard indoor unit (B), the standard indoor unit (C), the reheater (D), and the reheater (E) through two pipes, respectively. The humidifiers (G), (H) are not pipe-connected. A heat source device control box ("heat source device controlling device") 61 which is incorporated in the heat source device (A), a relay control box ("relay controlling device") 62 which is incorporated in the relay device (F), standard indoor unit control boxes ("standard indoor unit controlling devices") 63B, 63C which are incorporated in the standard indoor units (B), (C), reheater control boxes 64D, 64E which are incorporated in the reheaters ("reheater controlling devices") (D), (E), and a remote controller 65 are connected to one another by transmission lines, so that numerical values calculated in the control boxes and the remote controller are transmitted and received.

Figure 13:
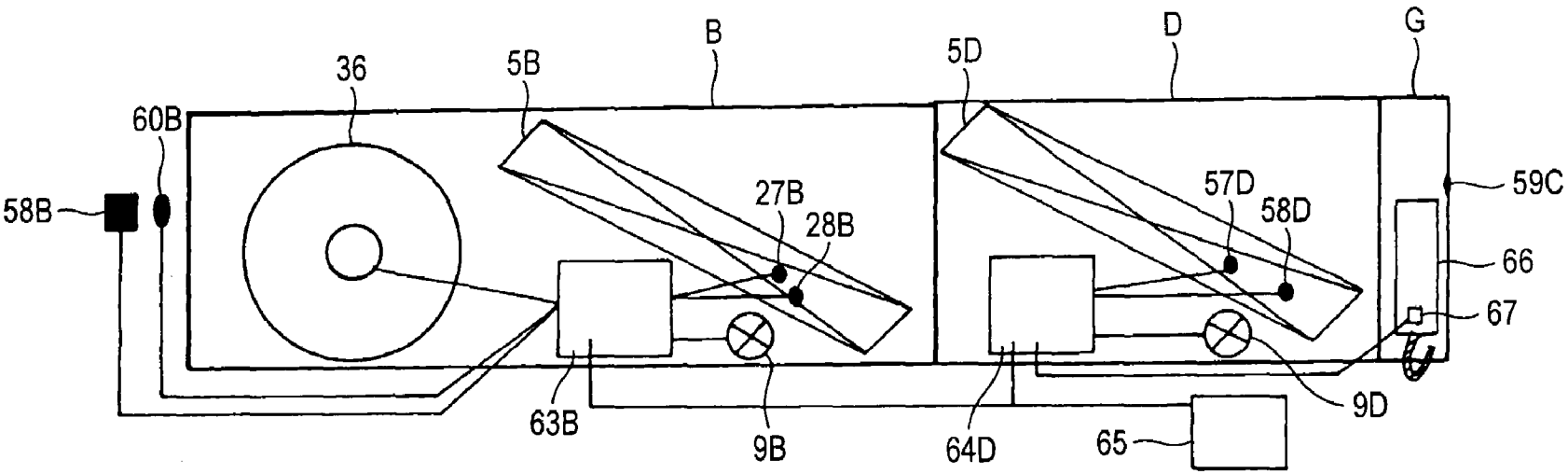
FIG. 13 is a diagram showing the configuration of an indoor unit.

FIG. 13 shows the configuration of an indoor unit configured by the standard indoor unit (B), the reheater (D), and the humidifier (G). The standard indoor unit (B), the reheater (D), and the humidifier (G) have respective cases, and the cases themselves are connected by screws or the like. Therefore, the standard indoor unit (B) is mounted, and thereafter the reheater (D) or the humidifier (G) can be mounted as required.

The standard indoor unit (B) is provided with the humidity detecting means 58B and the seventh temperature detecting means 60B on the air suction side, and is configured by the fan 36B, the indoor unit heat exchanger 5B, the fourth temperature detecting means 27B, the fifth temperature detecting means 28B, the first flow controller 9B, and the standard indoor unit control box 63B. The evaporator superheat of the indoor unit heat exchanger which is calculated by the standard indoor unit control box 63B from the fourth temperature detecting means 27B and the fifth temperature detecting means 28B is caused to approach the target value by controlling the first flow controller 9B. In the case where the indoor unit heat exchanger 5B is used as a condenser, the condenser subcool of the indoor unit heat exchanger which is calculated by the standard indoor unit control box 63B from the condensation temperature that is calculated by the heat source device control box 61 and the relay control box 62, and that is then transmitted to the standard indoor unit control box 63B, and the sensed value of the temperature detecting means 28B is caused to approach the target value by controlling the first flow controller 9B.

The reheater (D) is configured by the reheater heat exchanger 5D, the fourth temperature detecting means 27D, the fifth temperature detecting means 28D, the first flow controller 9D, and the reheater control box 64D. The condenser subcool of the reheater heat exchanger which is calculated by the reheater control box 64D from the condensation temperature that is calculated by the heat source device control box 61 and the relay control box 62, and that is then transmitted to the reheater control box 64D, and the sensed value of the temperature detecting means 28D is caused to approach the target value by controlling the first flow controller 9D. In the case where the reheater is used as a condenser, the evaporator superheat of the reheater heat exchanger which is calculated by the reheater control box 64D from the fourth temperature detecting means 27D and the fifth temperature detecting means 28D is caused to approach the target value by controlling the first flow controller 9D.

The humidifier (G) is configured by a moisture permeable film through which water can be evaporated, a water tank 66G, a water supply adjusting valve 67G which adjusts the quantity of water supplied from the water tank 66G to the moisture permeable film. The degree of opening of the water supply adjusting valve 67G is adjusted by a value transmitted from the standard heat exchanger control box 63B.

The standard indoor unit (C), the reheater (E), and the humidifier (H) have the same forms as the standard indoor unit (B), the reheater (D), and the humidifier (G), respectively.

It is a matter of course that the standard indoor unit control box 63B and the reheater control box 64D can be formed as a single control box.

Figure 14:
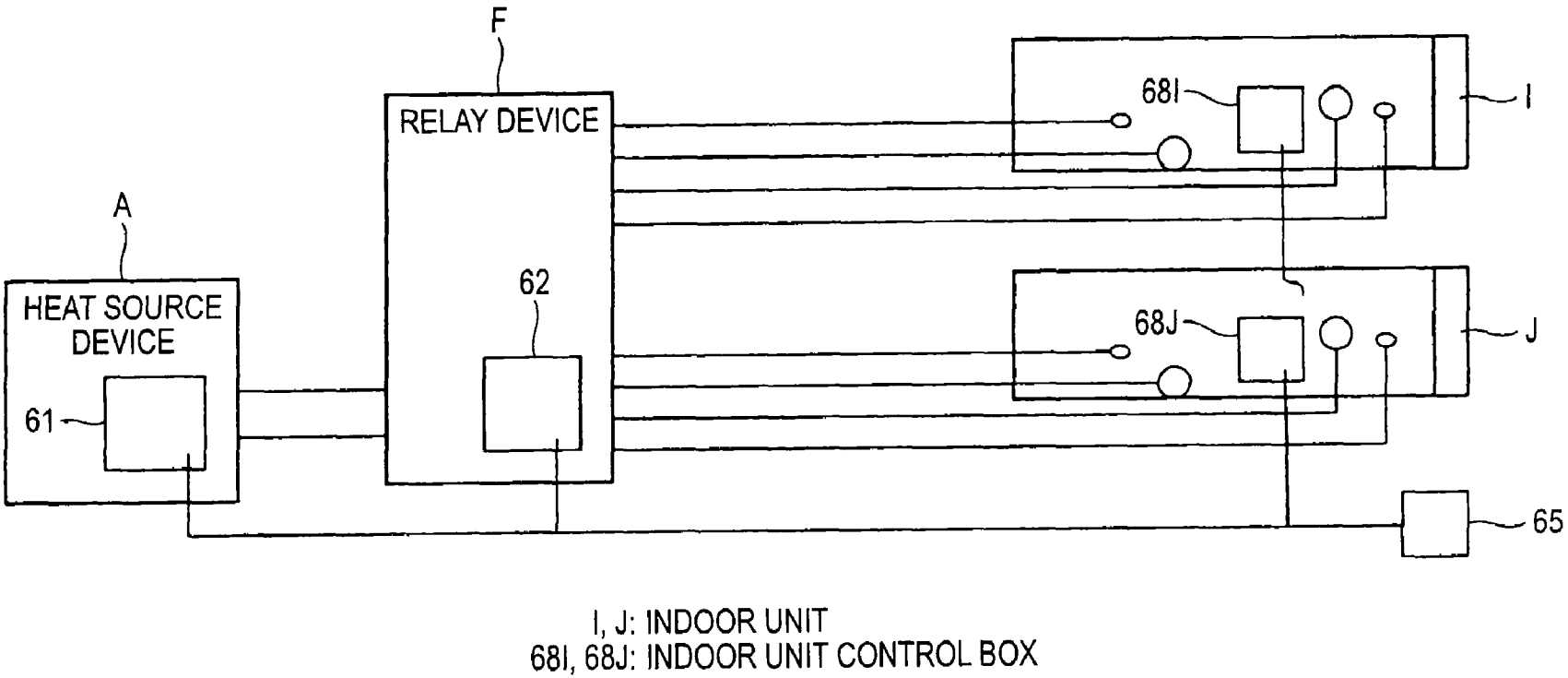
FIG. 14 is a diagram showing a control system.
Figure 15:
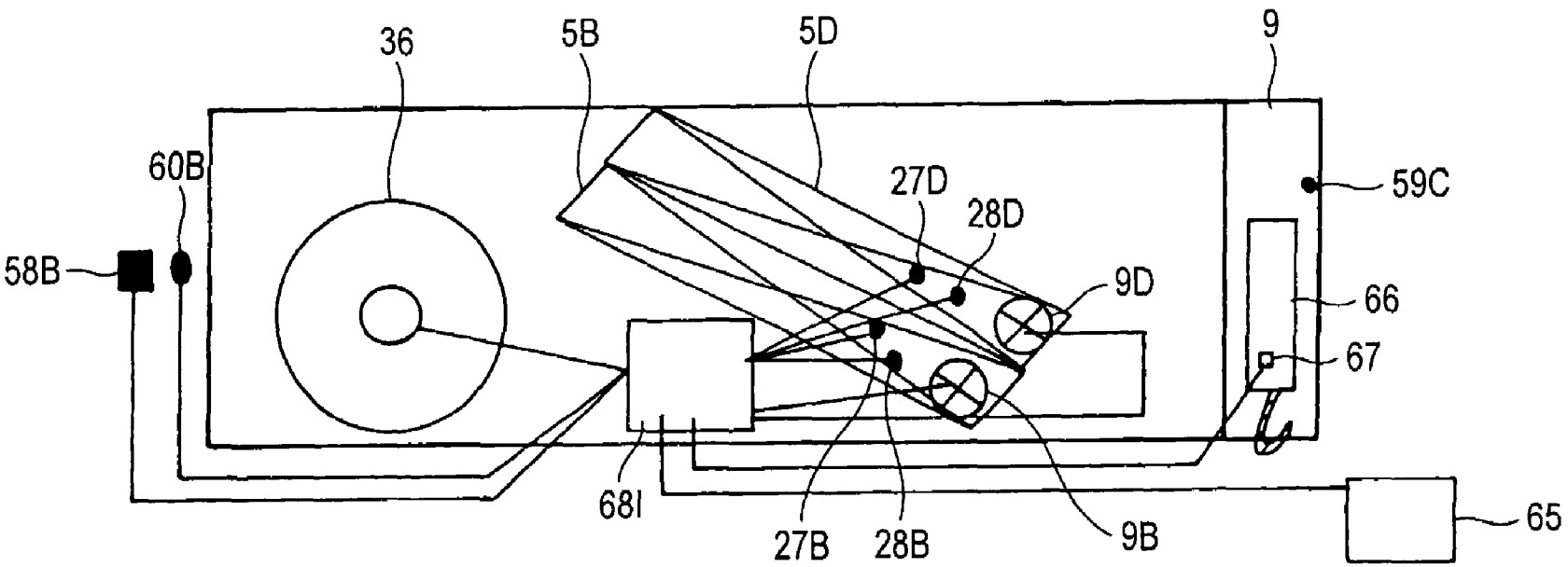
FIG. 15 is a diagram showing the configuration of an indoor unit.

It is a matter of course that the standard indoor unit and the reheater are not housed in separate cases but housed in a single case. FIGS. 14 and 15 are control system and indoor unit diagrams of indoor units (I), (J) in which the functions of a standard indoor unit and a reheater are housed in one case. According to the configuration, the size reduction is enabled.

Next, a humidity controlling operation will be described with reference to FIGS. 16 to 19.

Figure 16A:
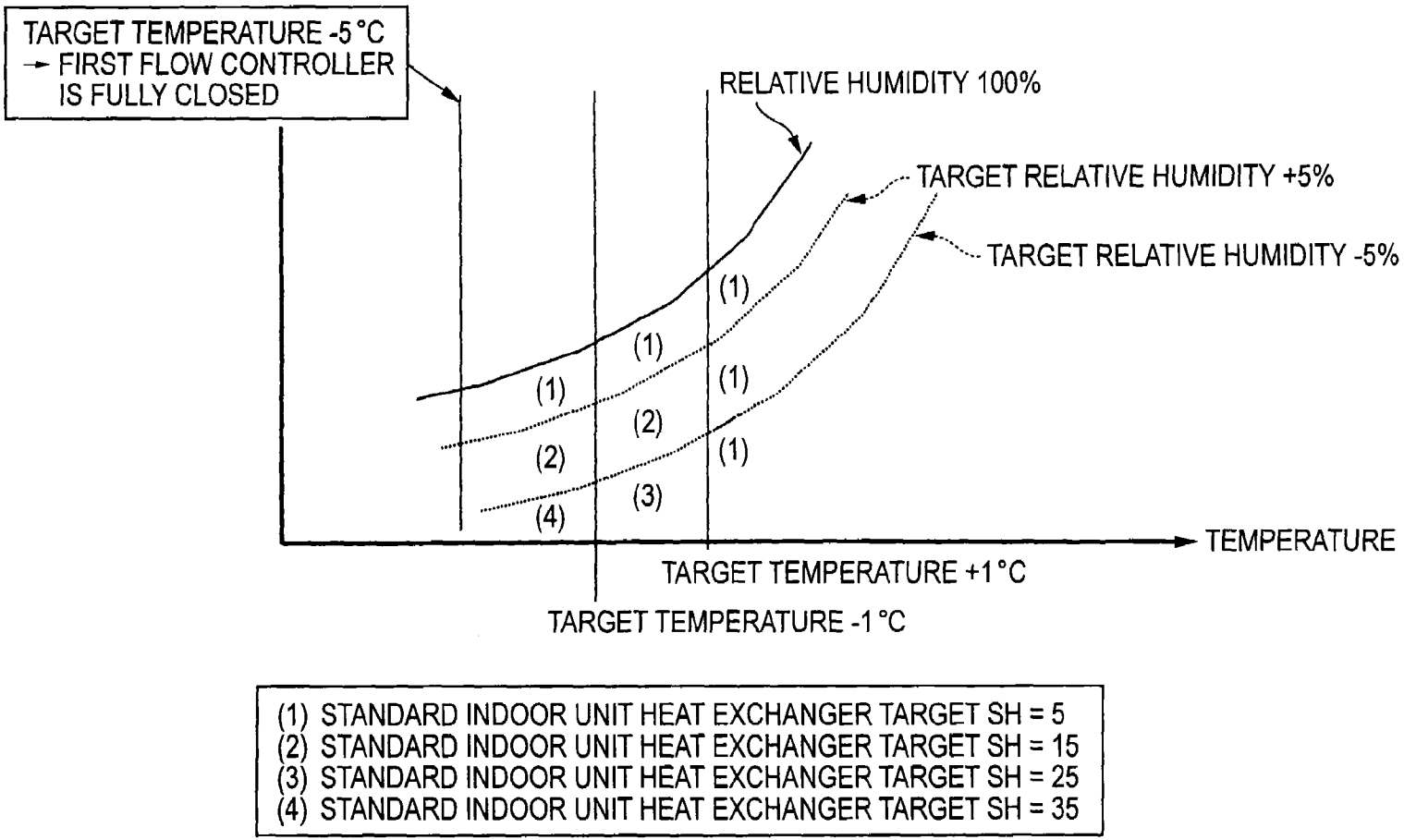
FIGS. 16A to 16C are psychrometric charts of an indoor unit.
Figure 16B:
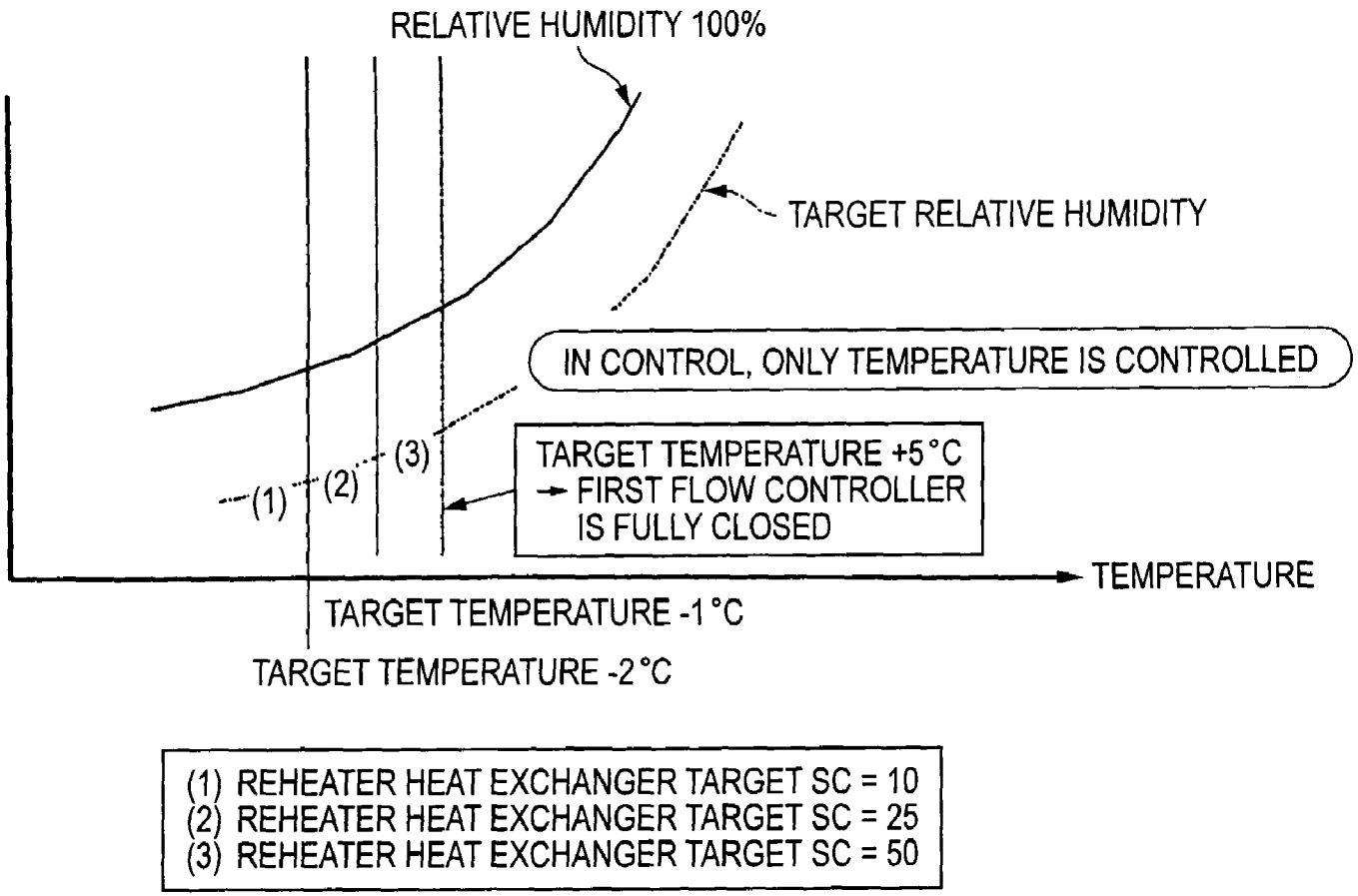
Figure 16C:
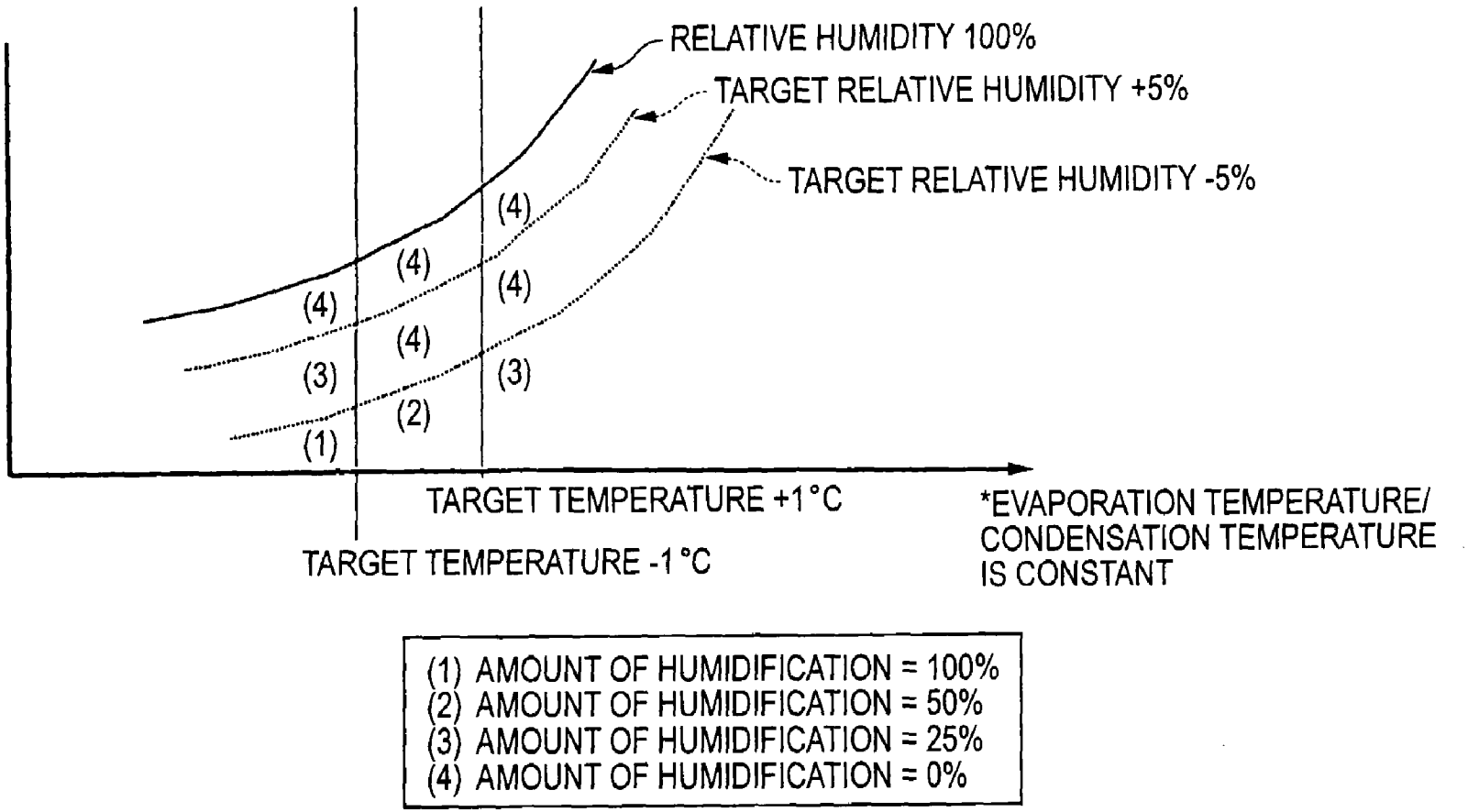
Figure 17A:
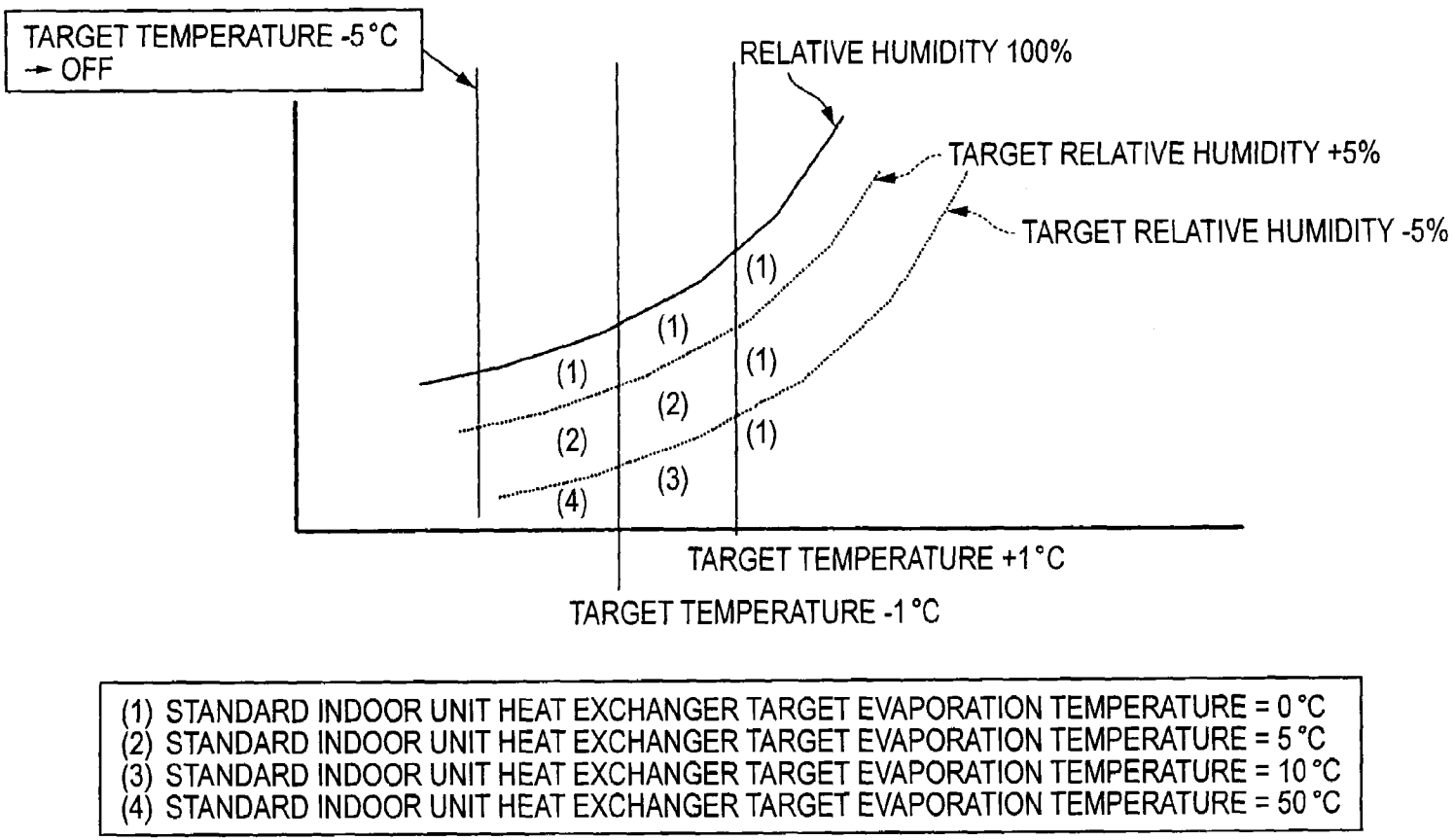
FIGS. 17A to 17C are psychrometric charts of an indoor unit.
Figure 17B:
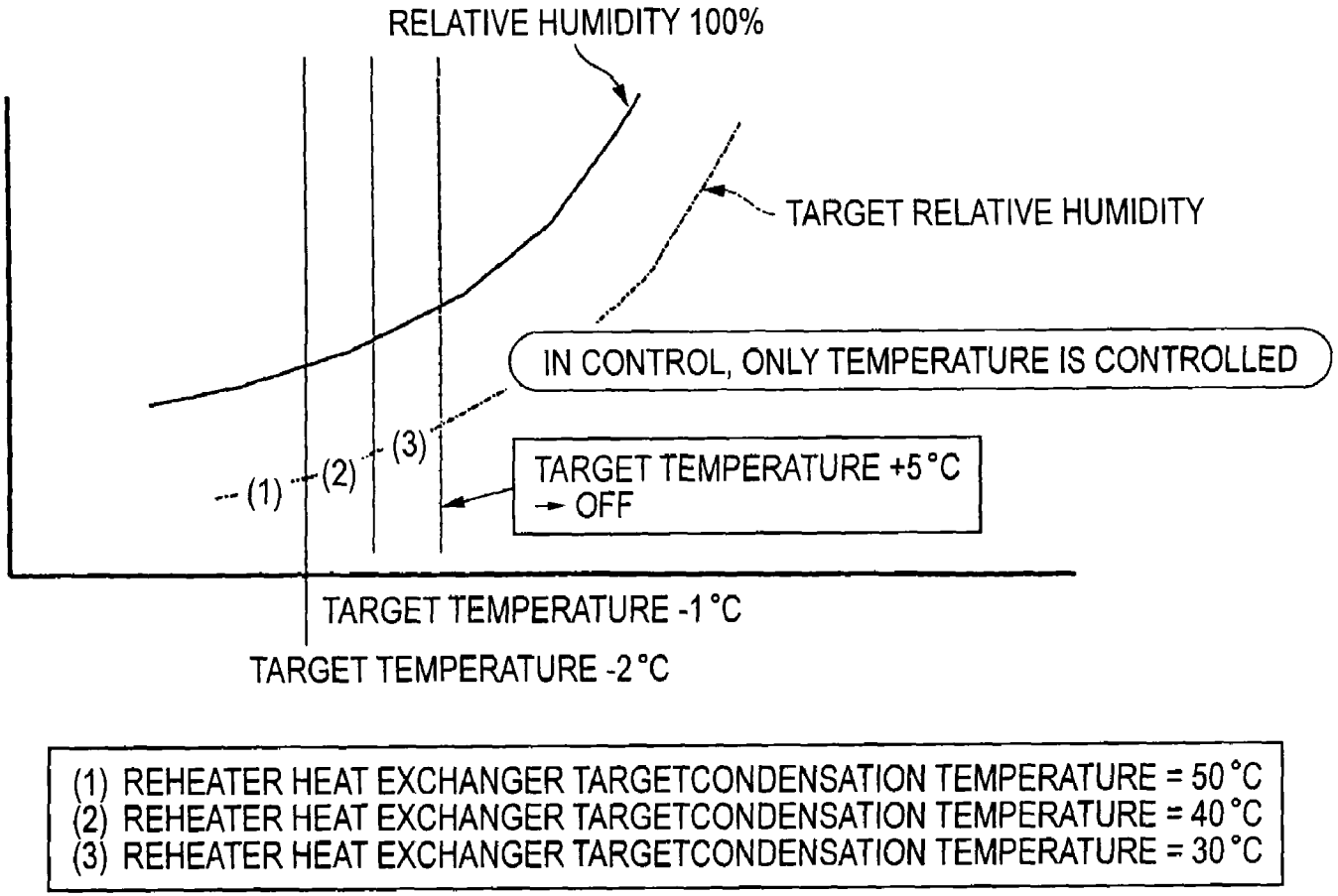
Figure 17C:
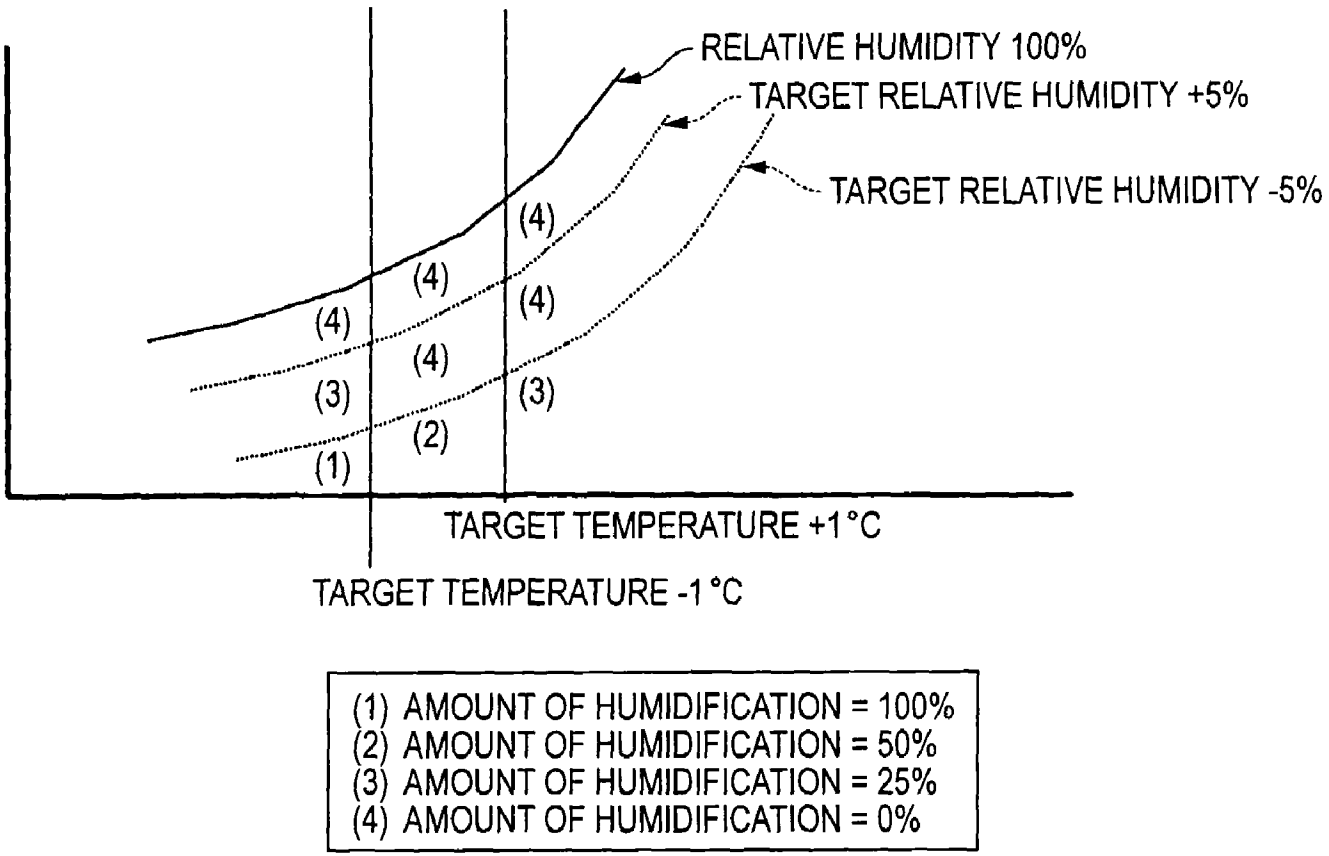

FIG. 16A is a psychrometric chart ("correlation table of temperatures and humidities") showing the control of the standard indoor unit (B), FIG. 16B is a psychrometric chart showing the control of the reheater (D), and FIG. 16C is a psychrometric chart showing the control of the humidifier (G). First, in the case where, with respect to the target temperature Xm and the target humidity Ym, the detection value of the seventh temperature detecting means 60B is X and that of the humidity detecting means 58B is Y, for example, the control of the standard indoor unit of FIG. 16A is partitioned into nine ranges which are combinations of three kinds of temperature ranges or $X-Xm \geqq 1$, $1>X-Xm \geqq -1$, and $X-Xm<-1$, and three kinds of humidity ranges or $Y-Ym \geqq 5\%$, $5\%>Y-Ym \geqq -5\%$, and $Y-Ym<-5\%$. In this example, the humidity is obtained by relative humidity sensing. In the nine humidity/temperature ranges, standard indoor unit heat exchanger ability settings of (1) to (4) are provided in each range, and the first flow controller 9B of the standard indoor unit (B) is controlled by standard indoor unit heat exchanger target superheat (standard indoor unit heat exchanger target SH). In this example, (1) is standard indoor unit heat exchanger target SH=5, (2) is standard indoor unit heat exchanger target SH=15, (3) is standard indoor unit heat exchanger target SH=25, and (4) is standard indoor unit heat exchanger target SH=35, so that, in the case where the temperature is higher than the target and the humidity is higher than the target, the ability of the standard indoor unit (B) becomes higher. In the standard indoor unit (B), when X−Xm <−5 is sensed, for example, the first flow controllers 9B, 9C may be fully closed to prevent the temperature from being excessively lowered. The nine humidity/temperature ranges are not restricted to nine ranges. In a similar manner as the standard indoor unit (B), also the control of the humidifier (G) of FIG. 16C has nine humidity/temperature ranges in accordance with the detection value of the seventh temperature detecting means 60B and that of the humidity detecting means 58B, humidifier ability settings of (1) to (4) are provided in each range, and the amount of humidification is controlled by the water supply adjusting valve 67G in accordance with the setting. In this example, (1) is the amount of humidification=100%, (2) is the amount of humidification=50%, (3) is the amount of humidification=25%, and (4) is the amount of humidification=0%, so that, in the case where the humidity is lower than the target and the temperature is lower than the target, the amount of humidification is set to be high. FIG. 16B shows the control of the reheater (D). The temperature range in the case where the detection value of the seventh temperature detecting means 60B is X and the target temperature is Xm is partitioned into four kinds of ranges or X−Xm≧0.5, 0.5>X−Xm≧−1, −1>X−Xm≧−2, and X−Xm<−2. Reheater heat exchange ability set values of (1) to (3) are provided in each range, and reheater ability OFF is provided in the range of X−Xm≧0.5. The first flow controller 9D of the reheater (D) is controlled by reheater heat exchanger target subcool (reheater heat exchanger target SC). In this example, (1) is reheater heat exchanger target SC=10, (2) is reheater heat exchanger target SC=25, (3) is reheater heat exchanger target SC=50, and reheater ability OFF is set to fully close the first flow controller 9D, so that, in the case where the temperature is lower than the target, the ability of the reheater (D) is enhanced. The control of the reheater (D) is determined only by the temperature range. Alternatively, in the same manner as the standard indoor unit (B), the determination may be conducted in accordance with the temperature and humidity range due to the detection value of the seventh temperature detecting means 60B and that of the humidity detecting means 58B. In an example such as that of FIGS. 16A to 16C, the ability of the standard indoor unit (B) is controlled by superheat of the indoor heat exchanger 5B, and that of the reheater (D) is controlled by subcool of the reheater heat exchanger 5D. Alternatively, as shown in FIGS. 17A to 17C, the ability of the standard indoor unit may be controlled by the evaporation temperature, and that of the reheater may be controlled by the condensation temperature.

Also the standard indoor unit (C), the reheater (E) and the humidifier (H) are controlled on the basis of psychrometric charts similar to those of FIGS. 16 and 17.

Figure 18:
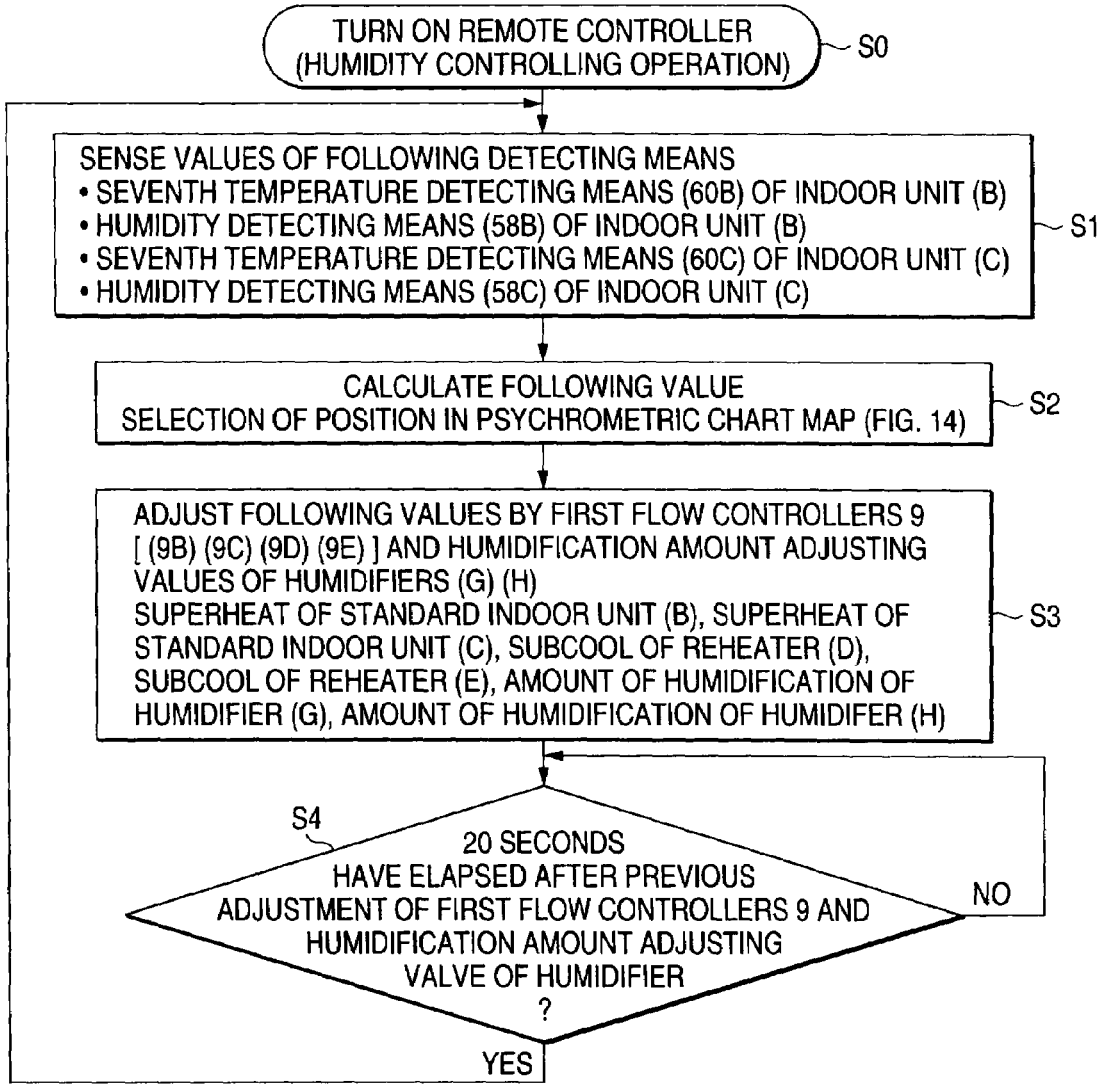
FIG. 18 is a control flowchart.
Figure 19:
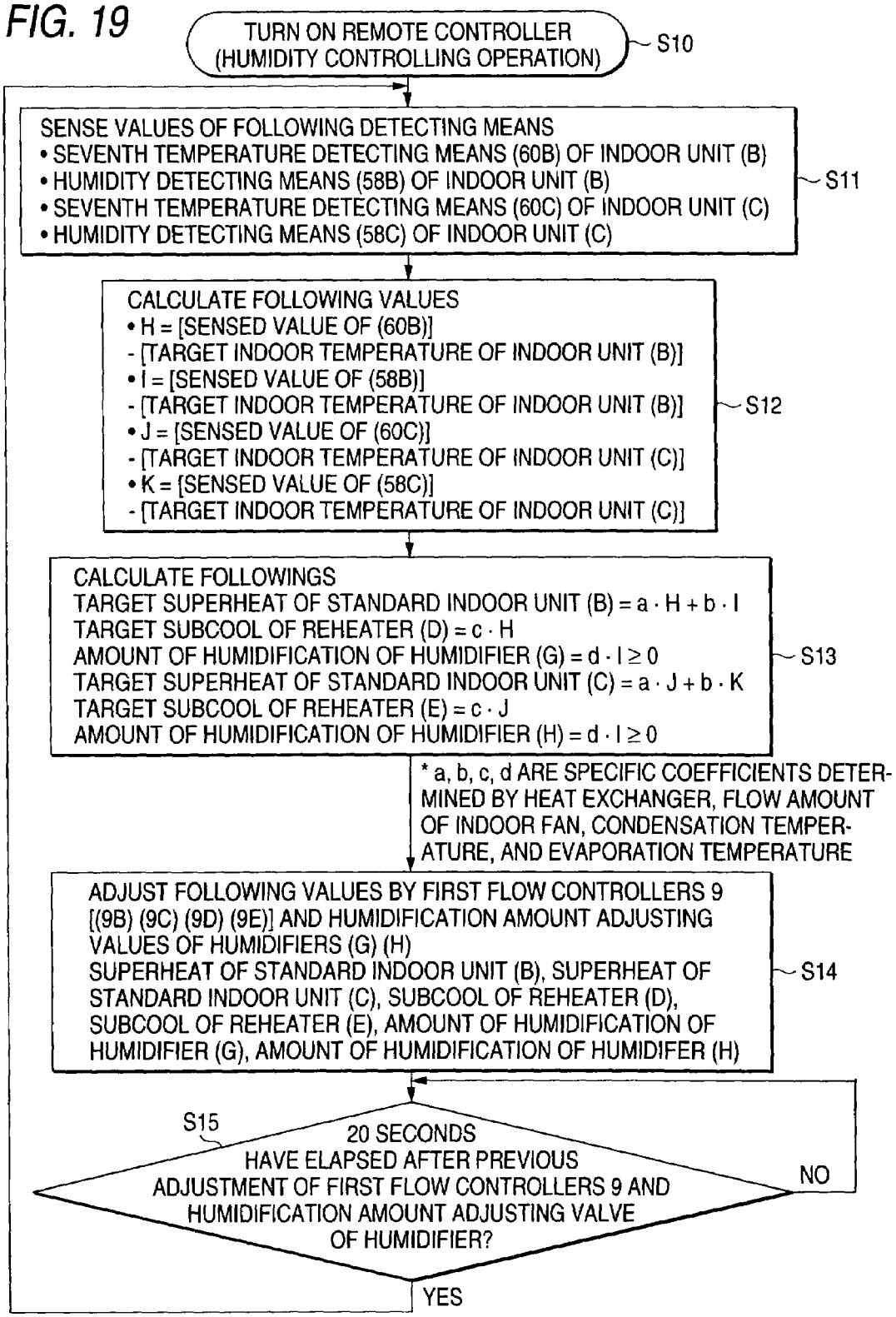
FIG. 19 is a control flowchart.

Next, a flowchart of a control of approaching the detection value of the seventh temperature detecting means and that of the humidity detecting means to the target values as shown in FIGS. 16A to 16C will be described with reference to the flowchart of FIG. 18.

First, the remote controller is turned ON to start a humidity controlling operation (step (hereinafter, abbreviated to "S") 0). Thereafter, the values of the seventh temperature sensing means 60B and humidity sensing means 58B of the indoor unit (B), and the seventh temperature sensing means 60C and humidity sensing means 58C of the indoor unit (C) are sensed (S1), and the current position in a psychrometric chart MAP such as shown in FIGS. 16A to 16C are selected (S2). The standard indoor unit superheat is adjusted by the first flow controllers 9B, 9C of the standard indoor units (B), (C), the reheater subcool is adjusted by the first flow controllers 9D, 9E of the reheaters (D), (E), and the amount of humidification is adjusted by the water supply adjusting valves 67G, 67H of the humidifiers (G), (H) (S3). Thereafter, it is judged whether a constant time period (for example, 20 sec.) has elapsed or not (S4). If the constant time period has elapsed, the control returns to S1. The operations of S1 and S2 may be shorter than the operation timing of S4.

Since the temperature and humidity of the indoor air are adjusted to the target values by adjusting the abilities of the standard indoor units and the reheaters as described above, the current room temperature and humidity can be accurately controlled.

Moreover, the adjustment indexes of the ability of the standard indoor units, the reheaters, or the humidifiers are provided in each of the ranges separated by the temperature and humidity in a psychrometric chart. Therefore, a temperature and humidity control in which control behaviors are clear, and which is highly reliable is enabled.

A similar operation control may be performed without using the psychrometric chart MAP, and with obtaining the adjustment values of the first flow controllers 9B, 9C, 9D, 9E and the water supply adjusting valves 67G, 67H by calculation. The method will be described with reference to the flowchart of FIG. 19.

First, the remote controller is turned ON to start a humidity controlling operation (S10). Thereafter, the values of the seventh temperature sensing means 60B and humidity sensing means 58B of the standard indoor unit (B), and the seventh temperature sensing means 60C and humidity sensing means 5CB of the standard indoor unit (C) are sensed (S11), and the followings are calculated (S12):

[sensed value of (60B)]−[target temperature of indoor unit (B)] Exp. (4)

[sensed value of (58B)]−[target temperature of indoor unit (B)] Exp. (5)

[sensed value of (60C)]−[target temperature of indoor unit (C)] Exp. (6)

[sensed value of (58C)]−[target temperature of indoor unit (C)] Exp. (7)

From the calculated values of S12, the target superheat of the standard indoor units (B), (C), the target subcool of the reheaters (D), (E), and the amount of humidification of the humidifiers (G), (H) are calculated (S13). The superheat of the standard indoor units (B), (C) is adjusted by the first flow controllers 9B, 9C of the standard indoor units (B), (C), the subcool of the reheaters (D), (E) is adjusted by the first flow controllers 9D, 9E of the reheaters (D), (E), and the amount of humidification is adjusted by the water supply adjusting valves 67G, 67H of the humidifiers (G), (H) (S14). Thereafter, it is judged whether a constant time period (for example, 20 sec.) has elapsed or not (S15). If the constant time period has elapsed, the control returns to S1.

In the embodiment described above, the humidifiers (G), (H) are incorporated. Alternatively, in the case where the apparatus is aimed particularly at dehumidification, or in accordance with selection of standard indoor units and reheaters, humidifiers may not be incorporated.

As described above, the abilities of standard indoor units or reheaters are adjusted by superheat or subcool of indoor heat exchangers or reheater heat exchanger. Therefore, individual temperature and humidity air conditioning of plural indoor units can be accurately controlled.

Embodiment 2

Figure 20:
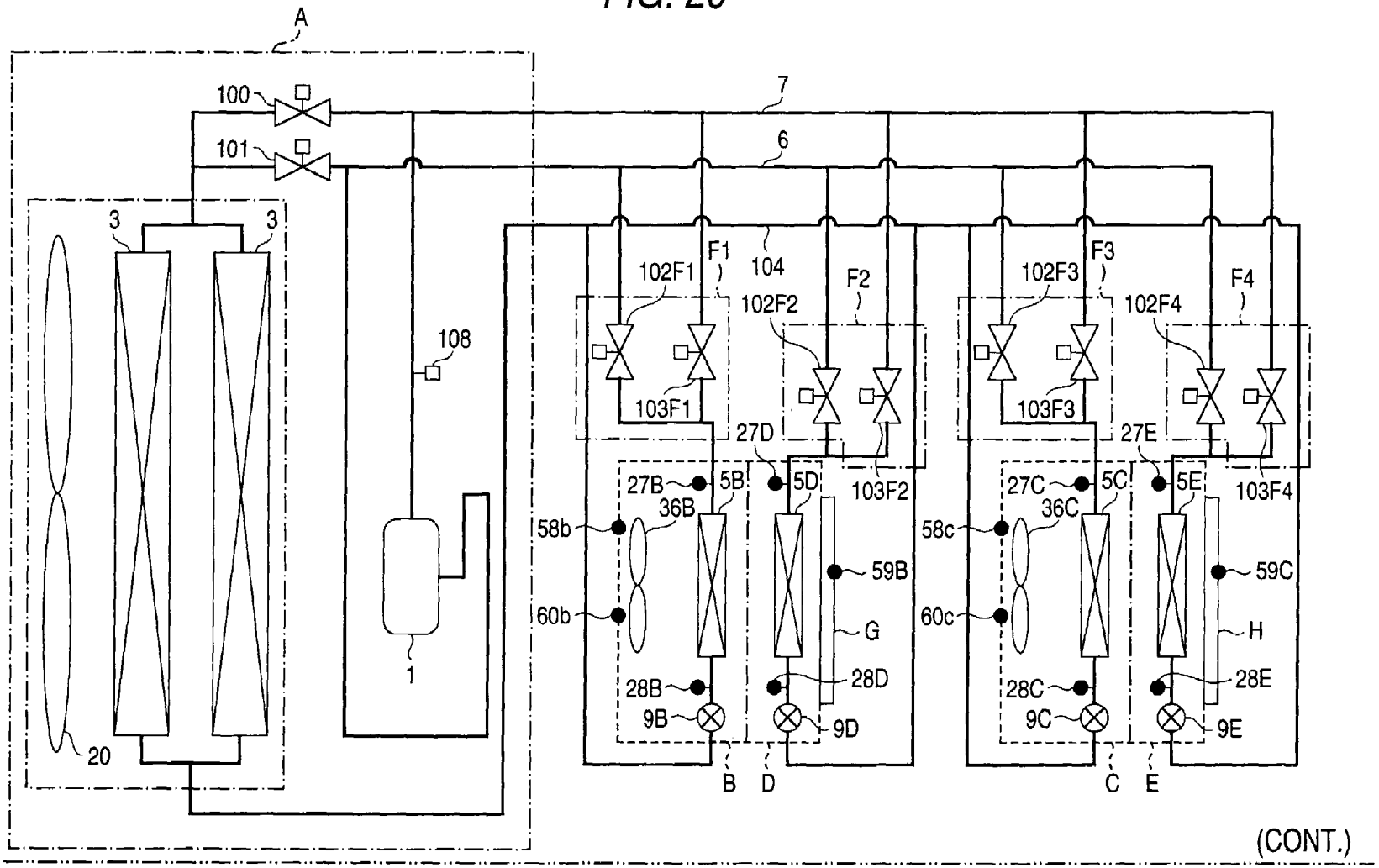
FIG. 20 is a refrigerant circuit diagram of Embodiment 2.

FIG. 20 is a refrigerant circuit diagram of an air conditioning apparatus of Embodiment 2 of the invention. In a type in which a heat source device is connected to relay devices through three pipes, cooling/heating/temperature and humidity air conditioning of plural indoor units can be individually controlled. Although the configuration in which two standard indoor units, two reheaters, and two humidifiers are connected to one heat source device will be described with reference to FIG. 20, the number of such units is not restricted to two, and any number of units may be used. The manner of connecting the standard indoor units, the reheaters, and the humidifiers, and the method of controlling the indoor units are identical with those shown in FIGS. 12 to 19.

Referring to FIG. 20, a relay device (F1) is configured so as to connect the first pipe 6, the second pipe 7, and a third pipe 104 to the two pipes of the standard indoor unit (B), a relay device (F2) is configured so as to connect the first pipe 6, the second pipe 7, and the third pipe 104 to the two pipes of the reheater (D), a relay device (F3) is configured so as to connect the first pipe 6, the second pipe 7, and the third pipe 104 to the two pipes of the standard indoor unit (C), and a relay device (F4) is configured so as to connect the first pipe 6, the second pipe 7, and the third pipe 104 to the two pipes of the reheater (E).

The heat source device (A) has: the variable capacity compressor 1; the heat source device heat exchanger 3; a first reversing valve 100; a second reversing valve 101; pressure sensing means 108 which is connected to the ejection or high-pressure side of the compressor 1; and the heat source device blower 20 which blows air to the heat source device heat exchanger 3. The suction side of the compressor 1 and the second reversing valve 101, and the ejection side of the compressor 1 and the first reversing valve 102 are connected to each other through pipes, respectively. The side of the second reversing valve 101 opposite to the side connected to the compressor 1, and that of the first reversing valve 100 opposite to the side connected to the compressor 1 are connected to each other through pipes to join together, and then connected to the two heat source device heat exchangers 3 through pipes. The connecting pipe of the first reversing valve 100 which is on the ejection side of the compressor 1, and which is connected to the compressor 1 is connected to the second pipe 7, the connecting pipe of the second reversing valve 101 which is on the suction side of the compressor 1, and which is connected to the compressor 1 is connected to the first pipe 6, and the side of the heat source device heat exchanger 3 opposite to the connections to the first reversing valve 100 and the second reversing valve 101 is connected to the third pipe 104.

The third connecting pipe 104 is connected to the standard indoor unit (B). In the standard indoor unit (B), one port of the first flow controller 9B which controls the flow amount of the refrigerant is connected to the third connecting pipe 104, the other port is connected to one port of the standard indoor unit heat exchanger 5B, and the other port is connected to the relay device (F1) through a pipe. In the relay device (F1), the pipe from the standard indoor unit is branched into two pipes, one of the pipes is connected to the first pipe 6 via a third reversing valve 102F1, and the other pipe is connected to the second pipe 7 via a fourth reversing valve 103F1.

Furthermore, the third connecting pipe 104 is connected to the reheater (D). In the reheater (D), one port of the first flow controller 9D which controls the flow amount of the refrigerant is connected to the third connecting pipe 104, the other port is connected to one port of the reheater heat exchanger 5D, and the other port is connected to the relay device (F2) through a pipe. In the relay device (F2), the pipe from the reheater is branched into two pipes, one of the pipes is connected to the first pipe 6 via a third reversing valve 102F2, and the other pipe is connected to the second pipe 7 via a fourth reversing valve 103F2.

The standard indoor unit (C) is configured in the same manner as the standard indoor unit (B), the reheater (E) is configured in the same manner as the reheater (D), and the relay devices (F3), (F4) are configured in the same manner as the relay devices (F1), (F2), respectively.

The fourth temperature detecting means 27B, 27C, 27D, 27E are connected to pipes of the indoor unit heat exchangers 5B, 5C and the reheater heat exchangers 5D, 5E on the side of the corresponding relay device, respectively. The fifth temperature detecting means 28B, 28C, 28D, 28E are connected to pipes on the side of the corresponding first flow controller, respectively.

In the same manner as FIG. 1, the standard indoor units (B), (C) further comprise: the indoor unit fans 36B, 36C; the humidity detecting means 58B, 58C which sense the humidities of air sucked by the indoor units; the third temperature detecting means 59B, 59C which sense the temperatures of air blow out by the indoor units; and the seventh temperature detecting means 60B, 60C which sense the temperatures of air sucked by the indoor units.

The refrigerant circuit of FIG. 20 is charged with a refrigerant such as R410A.

Cooling Operation.

The behavior in the cooling operation will be described with reference to FIG. 21.

Figure 21:
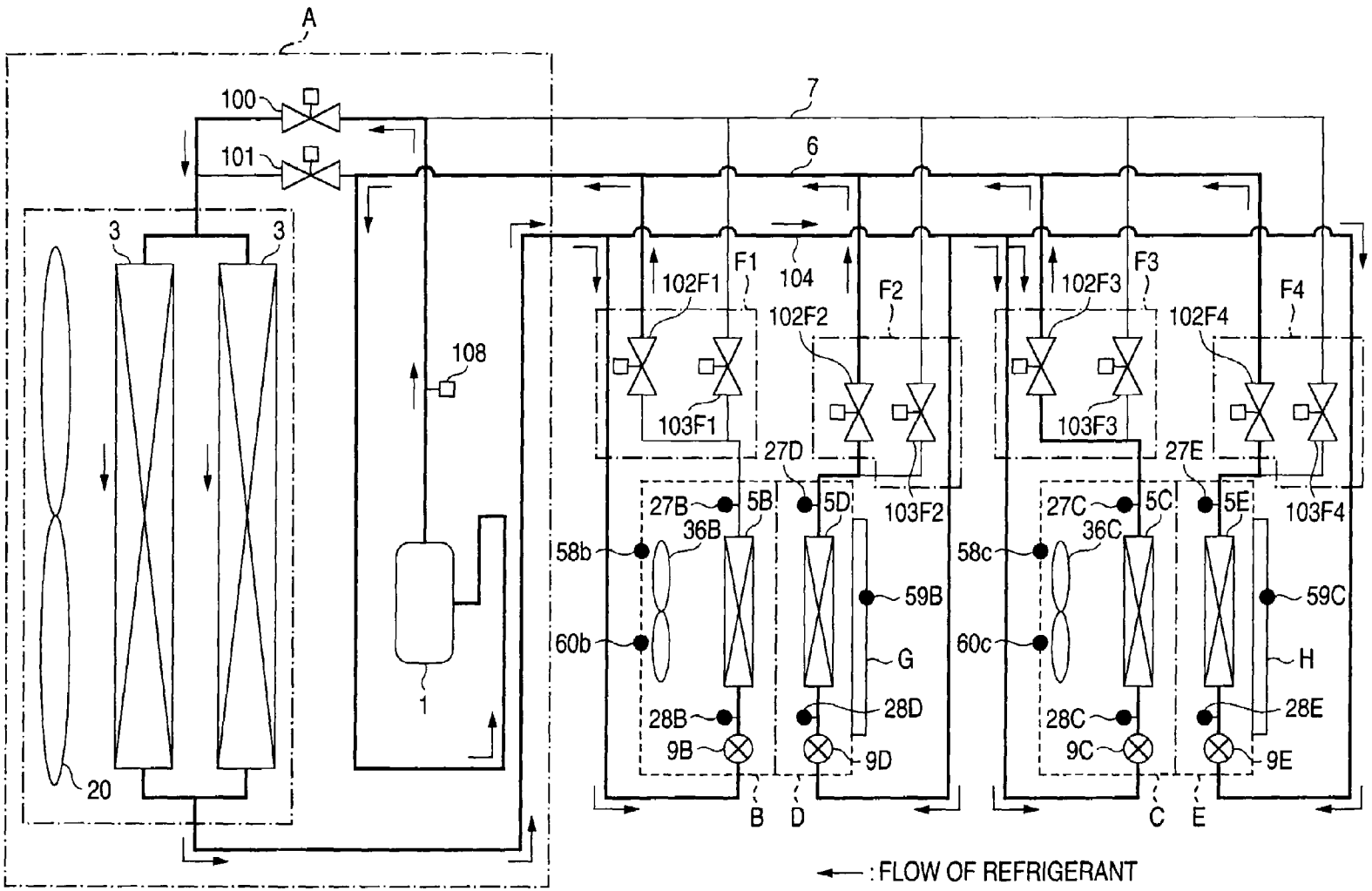
FIG. 21 is a diagram showing behavior of a cooling operation of Embodiment 2.

Referring to FIG. 21, as indicated by the solid arrows, the high-temperature and high-pressure gas refrigerant ejected from the compressor 1 passes through the first reversing valve 100, is condensed and liquefied in the heat source device heat exchanger 3, passes through the third pipe 104 and the first flow controllers 9B, 9C, 9D, 9E to be reduced in pressure to have a two-phase state, passes through the indoor heat exchangers 5B, 5C and the reheater heat exchangers 5D, 5E to be vaporized and gasified, and returns to the compressor 1 via the third reversing valves 102F1, 102F2, 102F3, 102F4 and the first pipe 6. At this time, all the first reversing valve 100 and the third reversing valves 102F1, 102F2, 102F3, 102F4 are opened, and all the second reversing valve 101 and the fourth reversing valves 103F1, 103F2, 103F3, 103F4 are closed.

Heating Operation.

Next, the behavior in the heating operation will be described with reference to FIG. 22.

Figure 22:
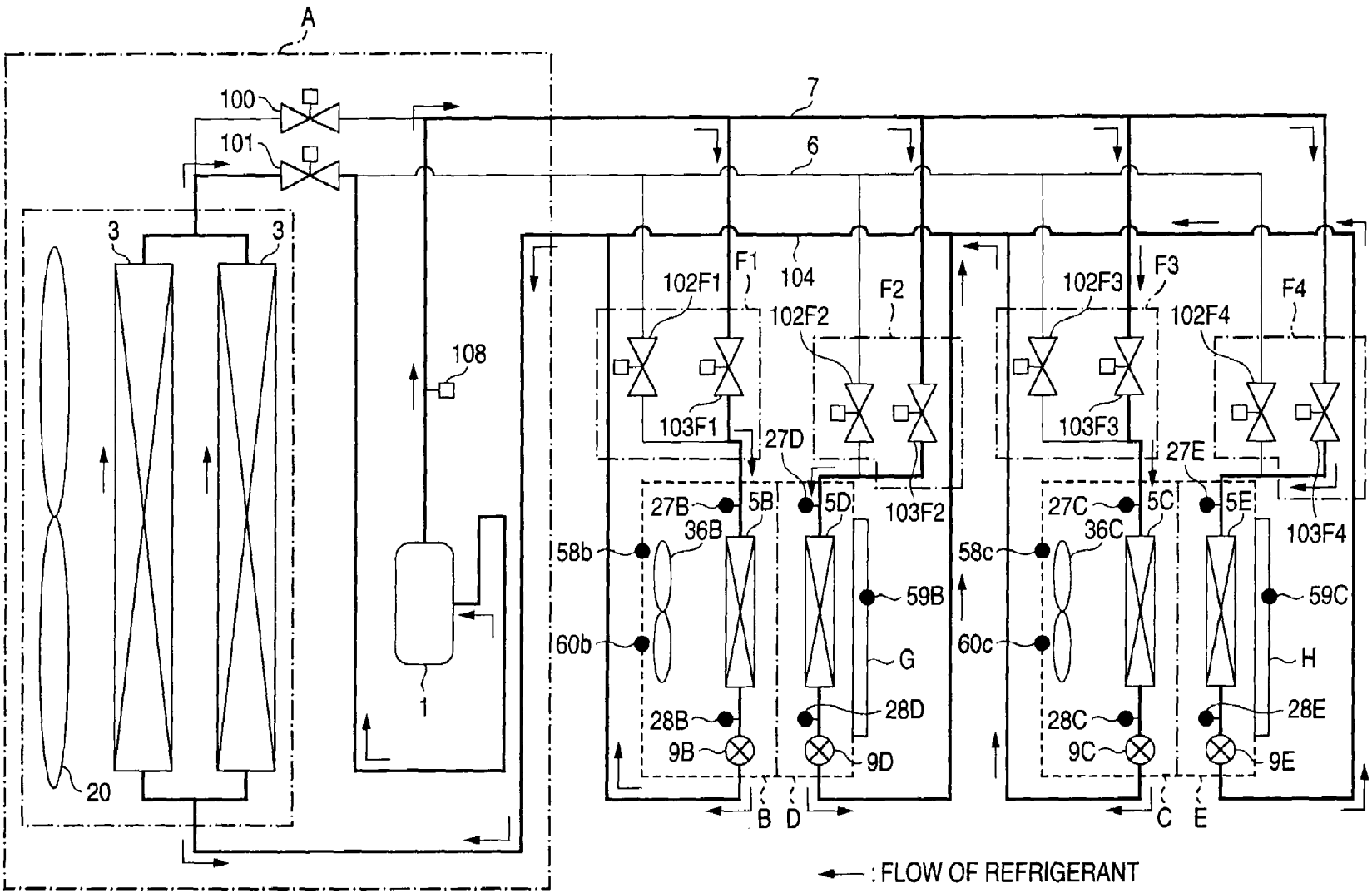
FIG. 22 is a diagram showing behavior of a heating operation of Embodiment 2.

Referring to FIG. 22, as indicated by the solid arrows, the high-temperature and high-pressure gas refrigerant ejected from the compressor 1 passes through the second pipe 7 and the fourth reversing valves 103F1, 103F2, 103F3, 103F4, passes through the indoor heat exchangers 5B, 5C and the reheater heat exchangers 5D, 5E to be condensed and liquefied, passes through the first flow controllers 9B, 9C, 9D, 9E to be reduced in pressure to have a two-phase state, vaporized and gasified in the third pipe 104 and the heat source device heat exchanger 3, and returns to the compressor 1 via the second reversing valve 101. At this time, all the first reversing valve 100 and the third reversing valves 102F1, 102F2, 102F3, 102F4 are closed, and all the second reversing valve 101 and the fourth reversing valves 103F1, 103F2, 103F3, 103F4 are opened.

Heating-Based Humidity Controlling Operation.

The behavior in the heating-based humidity controlling operation will be described with reference to FIG. 23.

Figure 23:
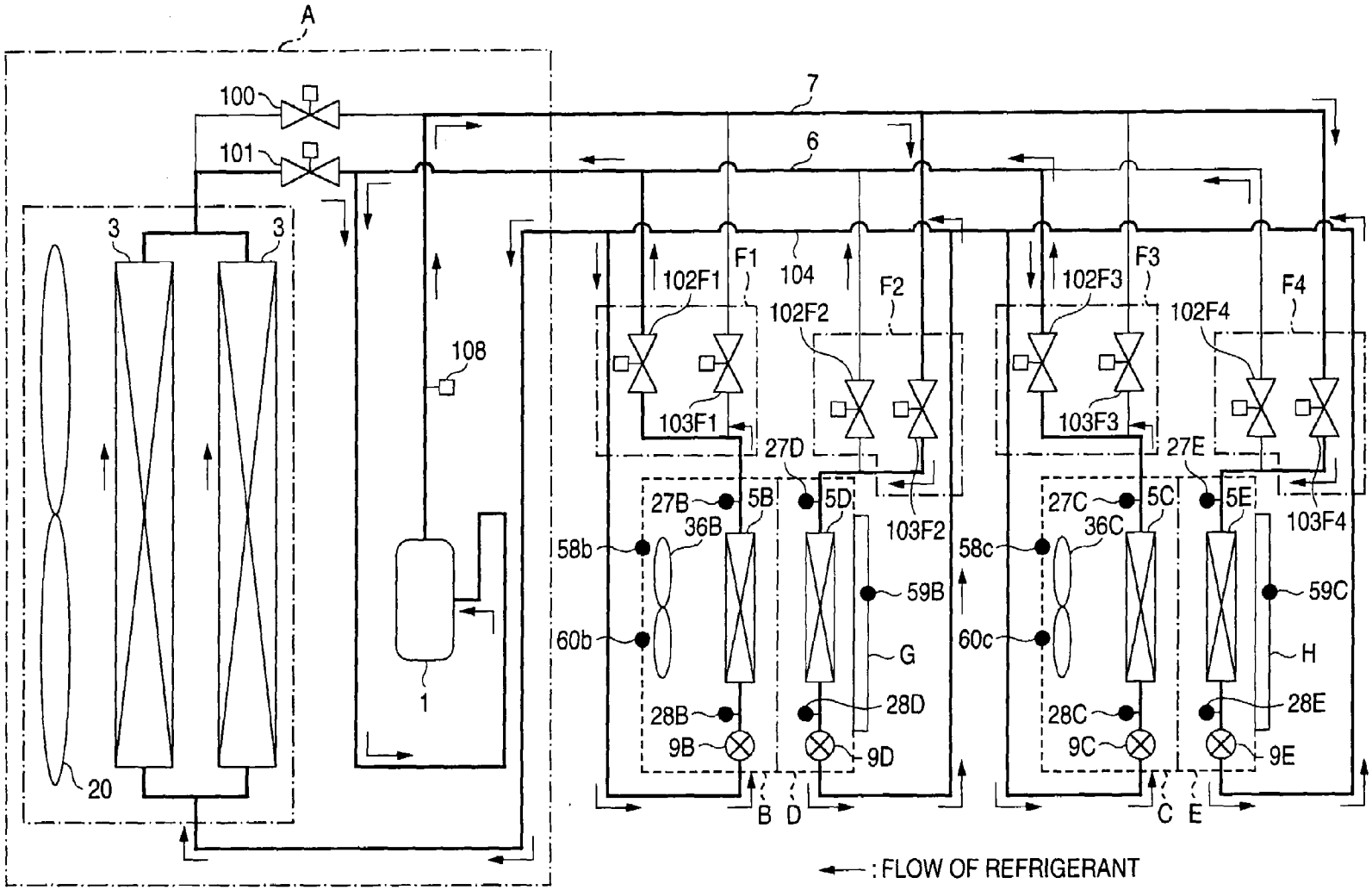
FIG. 23 is a diagram showing behavior of a heating-based humidity controlling operation of Embodiment 2.

Referring to FIG. 23, as indicated by the solid arrows, the high-temperature and high-pressure gas refrigerant ejected from the compressor 1 passes through the second pipe 7, passes through the reheater heat exchangers 5D, 5E via the fourth reversing valves 103F2, 103F4 connected to the reheaters (D), (E) to be condensed and liquefied, passes through the first flow controllers 9D, 9E to be reduced in pressure to have a two-phase state, and enters the third pipe 104. Part of the two-phase refrigerant of the third pipe 104 is reduced in pressure in the first flow controllers 9B, 9D of the standard indoor units (B), (C), then vaporized and gasified in the indoor heat exchangers 5B, 5C, and flows into the first pipe 6 connected to the standard indoor units. Part of the two-phase refrigerant of the third pipe 104 is vaporized and gasified in the heat source device heat exchanger 3, passes through the second reversing valve 101, then joins with the gas refrigerant of the first pipe 6, and returns to the compressor 1. At this time, the first reversing valve 100, the third reversing valves 102F2, 102F4, and the fourth reversing valves 103F1, 103F3 are closed, and the second reversing valve 101, the third reversing valves 102F1, 102F3, and the fourth reversing valves 103F2, 103F4 are opened.

Cooling-Based Humidity Controlling Operation.

The behavior in the cooling-based humidity controlling operation will be described with reference to FIG. 24.

Figure 24:
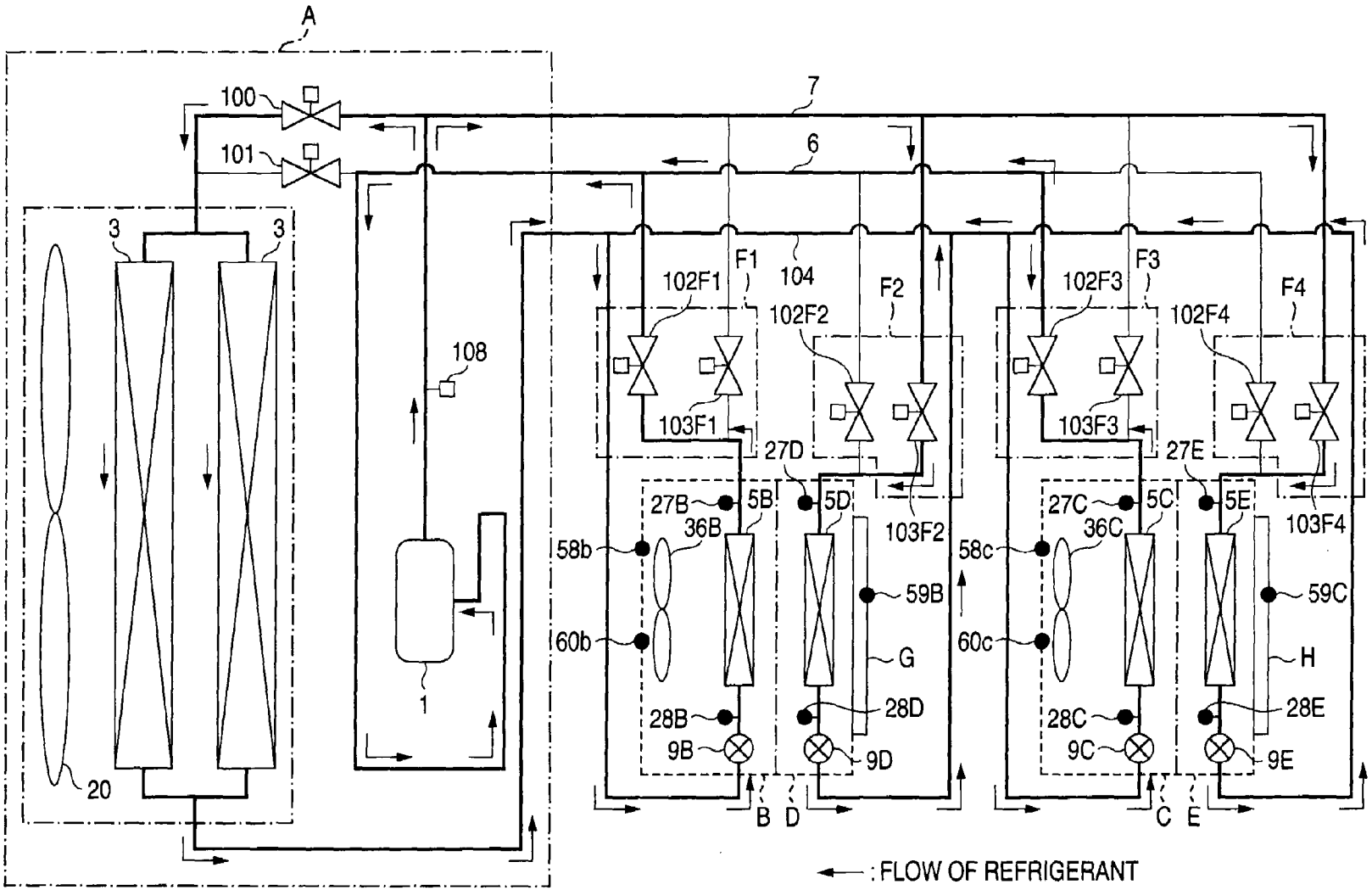
FIG. 24 is a diagram showing behavior of a cooling-based humidity controlling operation of Embodiment 1.

Referring to FIG. 24, as indicated by the solid arrows, part of the high-temperature and high-pressure gas refrigerant ejected from the compressor 1 passes through the first reversing valve 100, is condensed and liquefied in the heat source device heat exchanger 3, and flows into the third pipe 104. Part of the high-temperature and high-pressure refrigerant gas ejected from the compressor 1 flows into the second pipe 7, passes through the reheater heat exchangers 5D, 5E via the fourth reversing valves 103F2, 103F4 connected to the reheaters (D), (E) to be condensed and liquefied, passes through the first flow controllers 9D, 9E to be reduced in pressure to have a two-phase state, and flows into the third pipe 104 to join with the refrigerant which has passed through the heat source device heat exchanger 3. The refrigerant of the third pipe 104 is reduced in pressure in the first flow controllers 9B, 9D of the standard indoor units (B), (C), then vaporized and gasified in the indoor heat exchangers 5B, 5C, flows into the first pipe 6 connected to the standard indoor units, and returns to the compressor 1. At this time, the first reversing valve 100, the third reversing valves 102F1, 102F3, and the fourth reversing valves 103F2, 103F4 are opened, and the second reversing valve 101, the third reversing valves 102F2, 102F4, and the fourth reversing valves 103F1, 103F3 are closed.

INDUSTRIAL APPLICABILITY

As described above, in the air conditioning apparatus of the invention, each of plural indoor units can individually perform a heating operation, a cooling operation, or a dehumidifying and heating operation. Therefore, the apparatus is suitable for a case where settings of air conditioning in rooms must be individually changed, such as an office building or a store.

The invention claimed is:

1. An air conditioning apparatus comprising:
a heat source device including
a compressor,
a four-way reversing valve, and
a heat source heat exchanger;
a plurality of indoor units, each including
first and second heat exchangers,
a fan which blows air to said plurality of heat exchangers, and
a plurality of flow controllers respectively corresponding to said first and second heat exchangers;
a first connecting pipe and a second connecting pipe, wherein each of the first and second connecting pipes includes an end portion connected to said heat source device;
a first branching portion which is connected to said first and second heat exchangers of each of said indoor units, said first connecting pipe, and said second connecting pipe;
a second branching portion which joins pipes connected to said flow controllers of said indoor units together;
a joined pipe connected to said first connecting pipe and to said second connecting pipe; and
a valve device, disposed in said first branching portion, which causes said indoor units to selectively communicate with said first connecting pipe or said second connecting pipe
wherein the first and second heat exchangers of each indoor unit are connected to respective valves included in the valve device, such that the first and second heat exchangers of each indoor unit selectively communicate with the first connecting pipe or the second connecting pipe.

2. The air conditioning apparatus of claim 1,
wherein the first heat exchanger of the one of the plurality of indoor units is configured to alternately operate as a first condenser and a first evaporator, and
wherein the second heat exchanger of the one of the plurality of indoor units is configured to alternately operate as a second condenser and a second evaporator.

3. The air conditioning apparatus of claim 1, wherein the plurality of indoor units each further include a humidifier such that the fan blows air to the first and second heat exchangers and to the humidifier.

4. The air conditioning apparatus of claim 3, wherein the respective fan, first and second heat exchangers, and humidifier of one of the plurality of indoor units are joined together.

5. The air conditioning apparatus of claim 4, wherein the fan of the one of the plurality of indoor units creates an airflow, such that the humidifier is downstream of the first and second heat exchangers and the first and second heat exchanger are downstream of the fan.

6. The air conditioning apparatus of claim 3,
wherein the first heat exchanger of one of the plurality of indoor units is a reheater, and
wherein the reheater, the second heat exchanger, and the humidifier of the one of the plurality of indoor units are joined.

7. The air conditioning apparatus of claim 6, wherein the fan of the one of the plurality of indoor units creates an airflow, such that the humidifier is downstream of the reheater, the reheater is downstream of the second heat exchanger, and the second heat exchanger is downstream of the fan.

8. An air conditioning apparatus comprising:
a heat source device including
a compressor and
a heat source heat exchanger;
a plurality of indoor units each including
a plurality of heat exchangers,
a fan which blows air to said plurality of heat exchangers, and
a plurality of flow controllers respectively corresponding to said plurality of heat exchangers;

a first connecting pipe, a second connecting pipe, and a third connecting pipe, wherein each of the first, second, and third connecting pipes includes an end portion connected to said heat source device;

a first valve, disposed between said heat exchangers of said indoor units and said first connecting pipe;

a second valve, disposed between said heat exchangers and said second connecting pipe;

a third valve, disposed between said first connecting pipe and said heat source heat exchanger; and a fourth valve, disposed between said second connecting pipe and said heat source heat exchanger, wherein said first connecting pipe and said second connecting pipe are connected to a first inlet/outlet port of said heat source heat exchanger, wherein said third connecting pipe is connected to a second inlet/outlet port of said heat source heat exchanger, and wherein said first valve includes a plurality of valves respectively connected to said heat exchangers of said indoor units and to said first connecting pipe, such that the heat exchangers of said indoor units selectively communicate with the first connecting pipe or the second connecting pipe.

9. The air conditioning apparatus of claim 8, wherein a first heat exchanger of the plurality of heat exchangers of the one of the plurality of indoor units is configured to alternately operate as a first condenser and a first evaporator, and wherein a second heat exchanger of the plurality of heat exchangers of the one of the plurality of indoor units is configured to alternately operate as a second condenser and a second evaporator.

10. The air conditioning apparatus of claim 8, wherein the plurality of indoor units each further include a humidifier such that the fan blows air to the plurality of heat exchangers and to the humidifier.

11. The air conditioning apparatus of claim 10, wherein the respective fan, plurality of heat exchangers, and humidifier of one of the plurality of indoor units are joined together.

12. The air conditioning apparatus of claim 11, wherein the fan of the one of the plurality of indoor units creates an airflow, such that the humidifier is downstream of the plurality of heat exchangers and the plurality of heat exchanger is downstream of the fan.

13. The air conditioning apparatus of claim 10, wherein a first heat exchanger of the plurality of heat exchangers of one of the plurality of indoor units is a reheater, and wherein the reheater, a second heat exchanger, and the humidifier of the one of the plurality of indoor units are joined.

14. The air conditioning apparatus of claim 13, wherein the fan of the one of the plurality of indoor units creates an airflow, such that the humidifier is downstream of the reheater, the reheater is downstream of the second heat exchanger, and the second heat exchanger is downstream of the fan.

15. The air condition unit of claim 8, wherein said heat exchangers of said indoor units are parallely connected between said plurality of valves and said third connecting pipe.

* * * * *